US008482515B2

(12) United States Patent
Matsuda

(10) Patent No.: US 8,482,515 B2
(45) Date of Patent: Jul. 9, 2013

(54) DISPLAY APPARATUS AND DRIVING METHOD THEREOF

(75) Inventor: Yojiro Matsuda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1370 days.

(21) Appl. No.: 12/188,373

(22) Filed: Aug. 8, 2008

(65) Prior Publication Data

US 2008/0316168 A1 Dec. 25, 2008

Related U.S. Application Data

(63) Continuation of application No. 11/041,211, filed on Jan. 25, 2005, now Pat. No. 7,474,295.

(30) Foreign Application Priority Data

Jan. 27, 2004 (JP) ..... 2004-019057
Jan. 12, 2005 (JP) ..... 2005-005197

(51) Int. Cl.
*G09G 3/34* (2006.01)

(52) U.S. Cl.
USPC ..... 345/107; 345/33; 345/91; 345/169

(58) Field of Classification Search
USPC ..... 345/107, 33, 91, 169
See application file for complete search history.

(56) References Cited

U.S. PATENT DOCUMENTS

| | | | | |
|---|---|---|---|---|
| 3,612,758 | A | 10/1971 | Evans et al. | 178/5.4 R |
| 6,822,783 | B2 | 11/2004 | Matsuda et al. | 359/296 |
| 7,259,744 | B2 * | 8/2007 | Arango et al. | 345/107 |
| 2003/0048521 | A1 * | 3/2003 | Ikeda et al. | 359/296 |
| 2006/0038772 | A1 * | 2/2006 | Amundson et al. | 345/107 |
| 2007/0153361 | A1 | 7/2007 | Danner et al. | 359/296 |

FOREIGN PATENT DOCUMENTS

| | | |
|---|---|---|
| JP | 9-211499 | 8/1997 |
| JP | 11-202804 | 7/1999 |
| JP | 2002-250903 | 12/2002 |
| WO | WO 99/53373 | 10/1999 |

* cited by examiner

*Primary Examiner* — William Boddie
*Assistant Examiner* — Leonid Shapiro
(74) *Attorney, Agent, or Firm* — Fitzpatrick, Cella, Harper & Scinto

(57) ABSTRACT

A display apparatus includes a first substrate provided with a plurality of closed containers, a fluid filled in the closed containers, a plurality of positively charged particles which have a relative dielectric constant different from the fluid and are dispersed and held in the fluid, a plurality of negatively charged particles which have a same color as the positively charged particles and a relative dielectric constant different from the fluid and are dispersed and held in the fluid, and a pair of electrodes for generating an electric field in the closed containers. The display apparatus displays an image formed by a positional distribution of positively and negatively charged particles in each of the closed containers.

8 Claims, 15 Drawing Sheets

DISPLAY APPARATUS AND DRIVING METHOD THEREOF

This is a continuation of application Ser. No. 11/041,211, filed on Jan. 25, 2005.

FIELD OF THE INVENTION AND RELATED ART

The present invention relates to a display apparatus, such as an electrophoretic display apparatus which effects display on the basis of movement of (electrophoretic) migration particles, and a driving method of the display apparatus.

In recent years, an amount of information which an individual can deal with has been significantly measured due to a remarkable advance of digital technology. In connection with this, development of display as information output means has been performed actively, so that technological innovation for displays of high usabilities, such as high definition, low power consumption, light weight, thin shape, etc., has been continued. Particularly, in recent times, a high-definition display which is easy to read and has a display quality equivalent to printed matter has been desired. The display of this type is a technique indispensable to a next-generation product, such as electronic paper, electronic book, etc.

Incidentally, as a candidate for such displays, Evans et al. have proposed an electrophoretic display apparatus in which a dispersion medium containing colored charged electrophoretic (migration) particles and a coloring agent is disposed between a pair of substrates and an image with a contrast color between the colored charged migration particles and the colored dispersion medium is formed, in U.S. Pat. No. 3,612,758.

In such an electrophoretic display apparatus, however, there has arisen a problem such that a life of the display apparatus and a contrast are lowered due to inclusion of the coloring agent such as a dye. In view of these problems, such electrophoretic display apparatuses that an image with a contrast color between colored charged migration particles dispersed in a transparent dispersion medium and a coloring layer disposed on a substrate is formed without coloring the dispersion medium have been proposed in Japanese Laid-Open Patent Applications (JP-A) No. Hei 11-202804 and Hei 11-357369.

In order to realize bright color display in the above described electrophoretic display apparatuses, some constitutions can be considered. As one of the constitutions, International Publication WO99/53373 has proposed an electrophoretic display apparatus wherein migration particles of two types having mutually different charge polarities and colors are used, and a total of three colors including two colors of the migration particles of two types and a color of a coloring layer disposed on a substrate are displayable within a unit cell. As another constitution, JP-A No. 2002-350903 has proposed an electrophoretic display apparatus capable of displaying a total of three colors including a color of migration particles, a color of a dispersion medium, and a color of a coloring layer within a unit cell.

However, in order to switch the three colors within a unit cell in the above described conventional electrophoretic display apparatuses for realizing the bright color display, it is necessary to switch at least three particle distributions (i.e., three display states), so that independent three electrodes are required.

Generally, an electrophoretic display apparatus switches a display state by changing a distribution state of migration particles through application of DC (direct current) voltage to move the migration particles onto an electrode, so that the number of electrodes is increased in the case where a dispersion state of other migration particles is further created.

When the number of electrodes is increased, a process is complicated and a load is placed on a driver, thus leading to an increase in cost. Further, an area of electrode is increased within each pixel, so that an aperture ratio is not increased. As a result, a brightness and a contrast are limited.

SUMMARY OF THE INVENTION

The present invention has been accomplished in view of the above described circumstances.

An object of the present invention is to provide a display apparatus capable of switching a display state between a plurality of display states without increasing the number of electrodes.

Another object of the present invention is to provide a driving method for driving the display apparatus.

According to an aspect of the present invention, there is provided a display apparatus, comprising:

a first substrate provided with a plurality of closed containers, a fluid filled in the closed containers, a plurality of charged particles which have a relative dielectric constant different from the fluid and are dispersed and held in the fluid, and a pair of electrodes for generating an electric field in the closed containers, the display apparatus displaying an image formed by a positional distribution of charged particles in each of the closed containers, wherein the pair of electrodes generate an electric field having a non-uniform electric field strength in each of the closed containers, wherein a DC voltage is applied between the pair of electrodes to distribute the charged particles at one of electrode surfaces of the pair of electrodes and a neighborhood thereof, and wherein an AC voltage is applied between the pair of electrodes to gather the charged particles at a maximum electric field strength position and a neighborhood thereof or at a minimum electric field strength position and a neighborhood thereof, depending on a difference in relative dielectric constant between the charged particles and the fluid.

According to another aspect of the present invention, there is provided a display apparatus, comprising:

a first substrate provided with a plurality of closed containers, a fluid filled in the closed containers, a plurality of positively charged particles which have a relative dielectric constant different from the fluid and are dispersed and held in the fluid, a plurality of negatively charged particles which have a relative dielectric constant different from the fluid and are dispersed and held in the fluid, and a pair of electrodes for generating an electric field in the closed containers, the display apparatus displaying an image formed by a positional distribution of positively and negatively charged particles in each of the closed containers, wherein the pair of electrodes generate an electric field having a non-uniform electric field strength in each of the closed containers, wherein a first DC voltage is applied between the pair of electrodes to distribute the positively charged particles at one of electrode surfaces of the pair of electrodes and a neighborhood thereof, wherein a second DC voltage having a polarity opposite to that of the first DC voltage is applied between the pair of electrodes to distribute the negatively charged particles at one of electrode surfaces of the pair of electrodes and a neighborhood thereof, and wherein an AC voltage is applied between the pair of electrodes to distribute the positively charged particles and negatively charged particles at a maximum electric field strength position and a neighborhood thereof or at a minimum electric field strength position and a neighborhood thereof, depending on a difference in relative dielectric constant between the positively charged particles and the fluid and between the negatively charged particles and the fluid.

According to a further aspect of the present invention, there is provided a display method for apparatus displaying an image formed by a positional distribution of charged particles in each of closed containers on a display apparatus, comprising:

a first substrate provided with a plurality of closed containers, a fluid filled in the closed containers, a plurality of charged particles which have a relative dielectric constant different from the fluid and are dispersed and held in the fluid, and a pair of electrodes for generating an electric field in the closed containers;

the display method, forming and displaying an image, through the steps of:

applying a voltage the pair of electrodes to generate an electric field having a non-uniform electric field strength in each of the closed containers, creating such a state that a DC voltage is applied between the pair of electrodes to distribute the charged particles at one of electrode surfaces of the pair of electrodes and a neighborhood thereof, thereby to visually identify the distribution of the charged particles, and creating such a state that an AC voltage is applied between the pair of electrodes to distribute the charged particles at a maximum electric field strength position and a neighborhood thereof or at a minimum electric field strength position and a neighborhood thereof, depending on a difference in relative dielectric constant between the charged particles and the fluid, thereby to visually identify a second surface.

According to a still further aspect of the present invention, there is provided a display method for displaying an image formed by a positional distribution of positively and negatively charged particles in each of the closed containers on a display apparatus, comprising:

a first substrate provided with a plurality of closed containers, a fluid filled in the closed containers, a plurality of positively charged particles which have a relative dielectric constant different from the fluid and are dispersed and held in the fluid, a plurality of negatively charged particles which have a relative dielectric constant different from the fluid and are dispersed and held in the fluid, and a pair of electrodes for generating an electric field in the closed containers, the display method forming and displaying an image, through the steps of:

applying a voltage to the pair of electrodes to generate an electric field having a non-uniform electric field strength in each of the closed containers, creating such a state that a first DC voltage is applied between the pair of electrodes to distribute the positively charged particles at one of electrode surfaces of the pair of electrodes and a neighborhood thereof, thereby to visually identify the distribution of the positively charged particles, creating such a state that a second DC voltage having a polarity opposite to that of the first DC voltage is applied between the pair of electrodes to distribute the negatively charged particles at one of electrode surfaces of the pair of electrodes and a neighborhood thereof, thereby to visually identify the distribution of the negatively charged particles, and creating such a state that an AC voltage is applied between the pair of electrodes to distribute the positively charged particles and negatively charged particles at a maximum electric field strength position and a neighborhood thereof or at a minimum electric field strength position and a neighborhood thereof, depending on a difference in relative dielectric constant between the positively charged particles and the fluid and between the negatively charged particles and the fluid, thereby to visually identify a substrate surface.

In the present invention, display is effected by changing a dispersion state of migration particles through application of a DC voltage to electrode(s) and by moving the migration particles to a strong electric field area or a weak electric field area of a non-uniform electric field generated by a non-uniform electric field generation structure through application of an AC voltage to electrode(s). As a result, it becomes possible to effect switching between a plurality of display states without increasing the number of electrodes. Further, it is possible to obviate an increase in cost due to complicate process and a load on a driver. Further, it is also possible to obviate such a problem that an increase in area of electrode in each pixel impairs an aperture ratio, thus lowering a contrast.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, preferred embodiments for carrying out the present invention will be described with reference to the drawings.

First Embodiment

Figure 1:
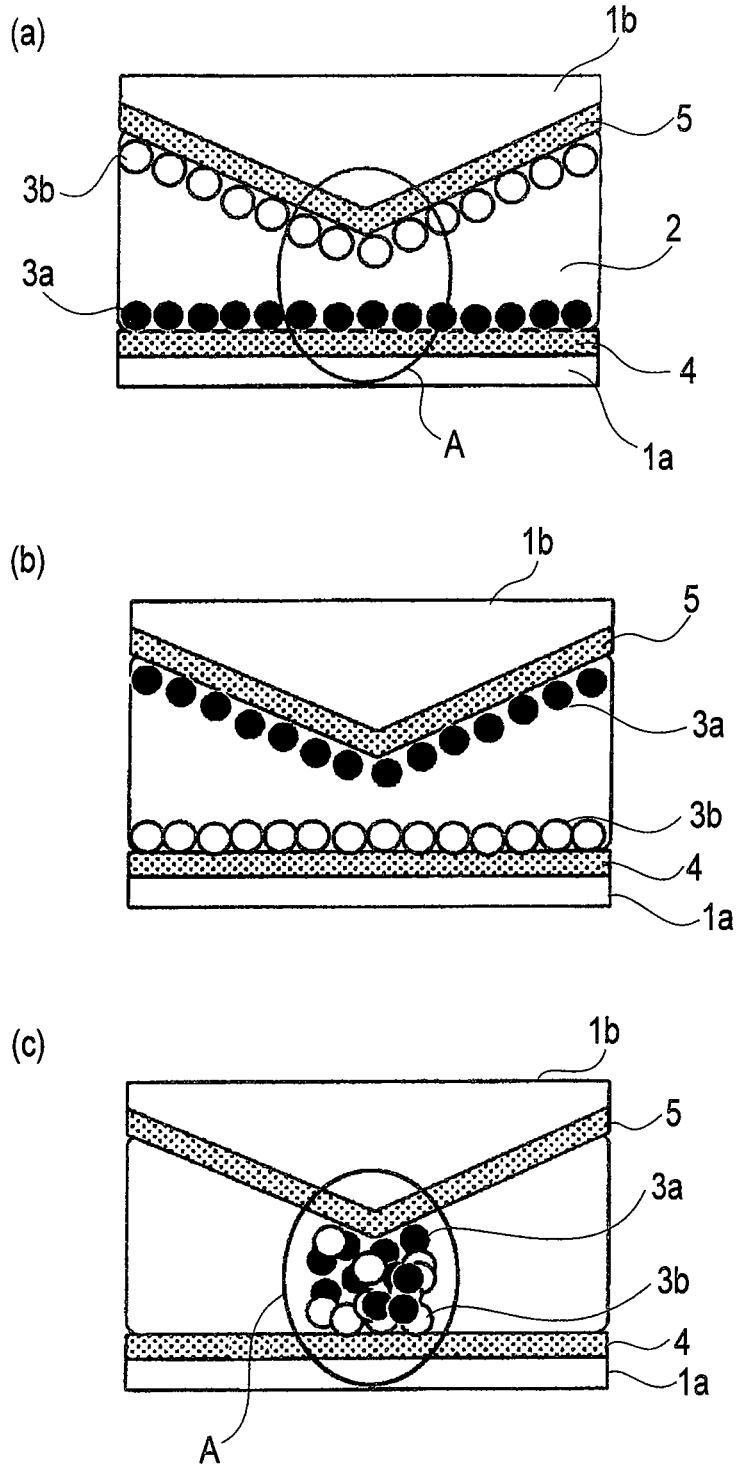
FIGS. 1(*a*) to 1(*c*) are schematic views showing a structure of an electrophoretic display device provided to an electrophoretic display apparatus according to First Embodiment of the present invention.

FIGS. 1(*a*) to 1(*c*) are schematic structural views of electrophoretic display apparatus according to this embodiment of the present invention. In FIG. 1, the electrophoretic display apparatus includes a first substrate 1*a* and a second substrate 1*b* which is disposed on a display side with a predetermined spacing between it and the first substrate 1*a*.

In a dispersion medium 2 filled in a closed container formed between the first substrate 1*a* and the second substrate 1*b*, (electrophoretic) migration particles of two types (first particles 3*a* and second particles 3*b*) having mutually different charge polarities and colors are dispersed. On the first substrate 1*a*, a first electrode 4 is formed and on the second substrate 1*b*, a second electrode 5 is formed. In this embodiment, as the first particles 3*a*, positively charged black particles are used and as the second particles 3*b*, negatively charged white particles are used. Further, the first electrode 4 is colored red.

Here, in the electrophoretic display apparatus, by applying a DC voltage to electrode(s), the first and second particles 3*a* and 3*b* are moved to different electrode surfaces, respectively, to change dispersion states of the migration particles, thus permitting display of two display states.

For example, when the second electrode 5 is grounded to 0 V and the first electrode 4 is supplied with a DC voltage of −10 V, as shown in FIG. 1(*a*), it is possible to move the positively charged first particles 3*a* to the first electrode surface and the negatively charged second particles 3*b* to the second electrode surface, respectively, whereby a white display state (hereinafter, referred to as a "first display state) is provided.

Contrary to this, when the second electrode 5 is grounded to 0 V and the first electrode 4 is supplied with a DC voltage of −10 V, as shown in FIG. 1(*b*), it is possible to move the positively charged first particles 3*a* to the second electrode surface and the negatively charged second particles 3*b* to the first electrode surface, respectively, whereby a black display state (hereinafter, referred to as a "second display state) is provided.

Incidentally, in the electrophoretic display apparatus, when the DC voltage is applied to the first electrode 4 as described above, an electrophoretic force acts on the migration particles, thereby to move the migration particles. The electrophoretic force is determined according to the following equation:

$$F=qE \tag{1}$$

wherein F represents an electrophoretic force, q represents a charge amount of particle, and E represents an external electric field.

As is understood from the equation (1), the migration particles are moved along an electric field vector created by DC voltage application and finally, an accumulation state of the migration particles at an electrode surface is utilized as a display state. Accordingly, the number of display states generally depends on the number of electrodes. As a result, when the number of display states is intended to be increased, the number of electrodes is increased. In view of this problem, in the electrophoretic display apparatus according to this embodiment, in order to permit an increase in number of display states without increasing the number of electrodes, the migration particles are caused to move not only by the electrophoretic force but also by a dielectrophoretic force.

Here, the dielectrophoretic force is a force, acting on particle in an electric field, which is clearly distinguished from the electrophoretic force, and is determined according to the following equation on the assumption that the particle is spherical:

$$F = 2\pi r^3 \varepsilon_1 \varepsilon_0 \left(\frac{\varepsilon_2 - \varepsilon_1}{\varepsilon_2 + 2\varepsilon_1}\right) \nabla E^2 \tag{2}$$

wherein F represents a dielectrophoretic force, r represents a radius of particle, $\in_0$ represents a dielectric constant (in vacuum), $\in_1$ represents a relative dielectric constant of dispersion medium, $\in_2$ represents a relative dielectric constant of particle, E represents an electric field, and ∇ represents a spatial differential.

As is understood from the equation (2), in the case where a non-uniform electric field is formed in a closed container, the migration particles are moved in a strong electric field area when a relative dielectric constant of the migration particles is larger than that of the surrounding dispersion medium. On the other hand, when the relative dielectric constant of the migration particles is smaller than that of the surrounding dispersion medium, the migration particles are moved in a weak electric field area.

The dielectrophoretic force (2) acts even at the time of DC voltage application but at that time, the electrophoretic force (1) exceeds the dielectrophoretic force (2), so that the migration particles are moved principally by the electrophoretic force (1), thus being less affected by the dielectrophoretic force (2).

However, in the case where an AC voltage is applied, the migration particles are moved between both the electrodes by an oscillatory electrophoretic force (1) at an AC voltage having a low frequency. However, when the frequency is increased, the migration particles gradually cannot follow the electrophoretic force (1). As a result, the dielectrophoretic force (2) dominantly acts on the migration-particles.

By utilizing such a dielectrophoretic force (2), e.g., by applying an AC voltage in the case of satisfying a relationship of (relative dielectric constant or migration particles)>(relative dielectric constant of dispersion medium), the migration particles can be moved in a strong electric field area of a distribution of non-uniform electric field (electric field gradient) in a closed container. Further, in the case where a relationship of (relative dielectric constant of migration particles)<(relative dielectric constant of dispersion medium) is satisfied, the migration particles can be moved in a weak electric field area of the distribution of non-uniform electric field (electric field gradient). As a result, the migration particles are collected around a position where the electric field in the closed container becomes maximum or a position where the electric field in the closed container becomes minimum.

A direction of the electrophoretic force (1) acting on the migration particles is determined depending on a direction of electric field and an electrical charge polarity of the migration particles, so that it is impossible to move charged particles of two types having different electrical charge polarities in the same direction. However, a direction of the dielectrophoretic force (2) is determined as one direction, irrespective of the electrical charge polarities of the migration particles, if only a magnitude relationship between dielectric constants of the migration particles and the dispersion medium (insulating liquid) is determined. Accordingly, by utilizing such a dielectrophoretic force (2), it becomes possible to move the migration particles of the both (different) polarities in the same electric field area without increasing the number of electrodes.

The dielectrophoretic force acts only in one direction, so that the migration particles once collected at the maximum or minimum electric field position cannot be returned to their original position. However, the migration particles collected at one position are placed in such a state that their collected state is removed and they are widely distributed over the electrode surface when they are moved to the electrode surface by the electrophoretic force. In the case where the migration particles are not completely distributed over the electrode surface by one moving operation, they are moved to the other electrode surface by inverting the polarity of the applied voltage and repetitively moved in such a reciprocation manner as desired, whereby such a state that the electrode surface is completely covered with the migration particles is substantially completely recovered. As a result, the collection state of the migration particles created by the dielectrophoretic force can be restored to the original state.

Incidentally, when the dielectrophoretic force is small, a response speed naturally becomes slow. On the other hand, the dielectrophoretic force is too large, even when the DC voltage is applied, the migration particles cannot be moved out of the strong electric field area (or the weak electric field area) to cause drive failure. Further, as is understood from the equation (2), in the case where there is no difference in relative dielectric constant between the migration particles and the dispersion medium, the dielectrophoretic force is lost. For this reason, the difference in relative dielectric constant between the migration particles and the dispersion medium may preferably be $5<|\in_1-\in_2|<50$, more preferably $8<|\in_1-\in_2|<20$.

The frequency of the AC voltage may be any one so long as the migration particles have not substantially respond to positive and negative voltages in one period at the frequency, i.e., so long as it is not less than a frequency at which the dielectrophoretic force becomes dominant. The frequency, however, is ordinarily not less than several hundred Hz. An amplitude of the AC voltage is determined by a movement speed of the migration particles required as the display apparatus but a withstand voltage of the driver must be taken into consideration. A degree of non-uniformity of the electric field created by the AC voltage is determined by an arrangement or a shape of electrode but is different also depending on a particle size and a difference in relative dielectric constant between the migration particles and the insulating liquid. The waveform of the AC voltage is not particularly limited but may be those of rectangular wave and sine wave, and a waveform having an asymmetrical peak value.

As shown in FIG. 1, in the case where the second electrode 5 is disposed so that a distance between the first electrode surface and the second electrode surface becomes smaller with a location thereof closer to a center portion of a closed container, such a non-uniform electric field (electric field gradient) that the center portion becomes a strong electric field area is formed in the closed container when the AC voltage is applied.

For example, in the case where the relationship of (relative dielectric constant of migration particles)>(relative dielectric constant of dispersion medium) is satisfied, when the AC voltage is applied between the first electrode 4 and the second electrode 5 as described above, the first particles 3*a* and the second particles 3*b* are moved to the strong electric field area (area A) as shown in FIG. 1(*c*) to expose the first electrode surface. As a result, red display is effected. Hereinbelow, this display state is referred to as a "third display state".

More specifically, in this embodiment, it is possible to effect switching between the first and second display states by applying the DC voltage to provide the electrophoretic force, and it is possible to effect switching to the third display state by applying the AC voltage to provide the dielectrophoretic force.

As described above, by applying the DC voltage to the first electrode 4, the dispersion state of the migration particles is changed to effect display and by applying the AC voltage to the first and second electrodes 4 and 5, the first and second particles 3*a* and 3*b* (migration particles) are moved in the strong electric field area (or the weak electric field area) of the non-uniform electric field to effect display. As a result, it becomes possible to perform switching between the plurality of display states (the first, second and third display states) without increasing the number of electrodes. When the third display state, i.e., such a state that the substrate surface is exposed is provided by using only the electrophoretic force (1), an additional one electrode is required but in this embodiment, the number of electrodes is still two, so that an increase in number of drive circuits can be obviated.

As described above, in addition to utilization of the electrophoretic force for pixel movement similarly as in the conventional electrophoretic display apparatus, by utilizing the dielectrophoretic force, it is possible to effect switching of the plurality of display states without increasing the number of electrodes. As a result, it is possible to obviate an increase in cost due to complicated process or load on drivers. Further, such a problem that an aperture ratio is impaired by an increase in area of electrodes within pixel to lower a contrast can also be solved.

Incidentally, in the foregoing description, such a constitution that the distance between the electrode surfaces of the first and second electrodes 4 and 5 is not constant but varies so as to provide a maximum and a minimum is described as the non-uniform electric field penetration structure for creating a desired non-uniform electric field (electric field gradient) within closed container. Further, in the case of employing such an electrode arrangement, i.e., an electrode arrangement in which a pixel-collected state is used as one display state, the strong electric field area of the non-uniform electric field is formed in such an area that the distance between the electrodes becomes a minimum, and on the other hand, the weak electric field area is formed in such an area that the distance between the electrodes becomes a maximum.

However, the non-uniform electric field generation structure for generating the non-uniform electric field distribution sufficient to provide the third display state is not limited to the above described constitution (electrode arrangement) but may, e.g., be such a constitution that the non-uniform electric field distribution (electric field gradient) is provided in the closed container by a difference in dielectric constant between members forming the closed container. Further, as described later, it is also possible to provide the non-uniform electric field (electric field gradient) within the closed container by appropriately changing the electrode arrangement and/or the electrode shape. It is also possible to use these constitutions in combination.

Incidentally, the electrophoretic display apparatus in this embodiment employs the migration particles of two types consisting of white and black particles but may employ either one type of migration particles. For example, only the black particles 3*a* are present, the dispersion medium 2 is transparent, so that the display states shown in FIGS. 1(*a*) and 1(*b*) are visually identified as the same black state, and that shown in FIG. 1(*c*) is visually identified as the red state for the substrate surface. When the color of the substrate is white, it is possible to effect white/black display. In FIGS. 1(*a*) and 1(*b*), the voltages are opposite in polarity to each other, so that it is possible to prevent localization of DC voltage by alternately using the display states of FIGS. 1(*a*) and 1(*b*).

Second Embodiment

Next, Second Embodiment of the present invention will be described.

Figure 2:
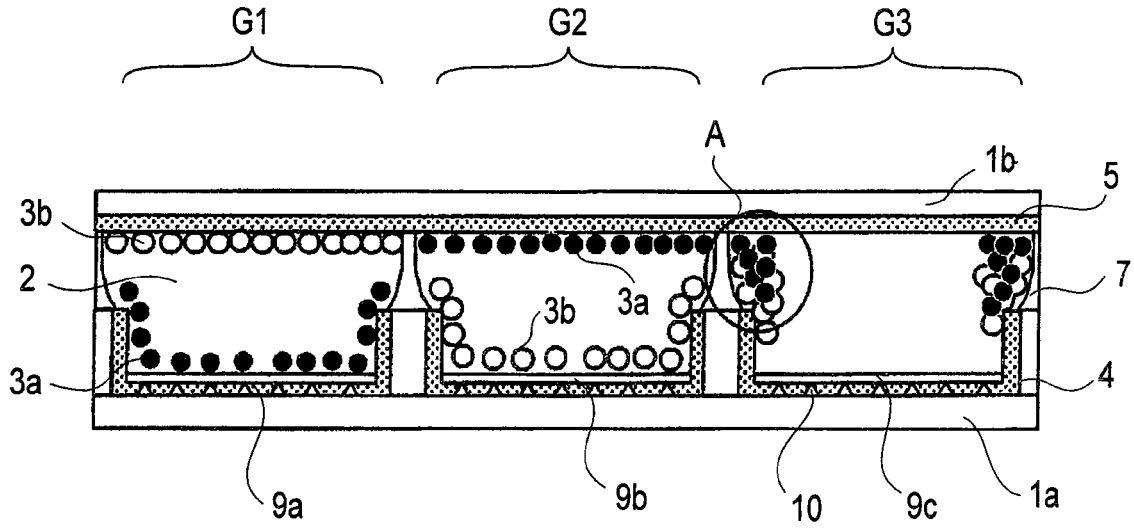
FIG. 2 is a schematic view showing a structure of an electrophoretic display device provided to an electrophoretic display apparatus, capable of effecting color display, according to Second Embodiment of the present invention.

FIG. 2 is a schematic structural view of an electrophoretic display device provided in an electrophoretic display apparatus capable of effecting color display according to this embodiment. In FIG. 2, members or portions indicated by the same reference numerals as in FIGS. 1(*a*) to 1(*c*) represent the same or corresponding members or portions.

Referring to FIG. 2, a first pixel G1, a second pixel G2, and a third pixel G3 are disposed in parallel to constitute one pixel. A partition wall 7 is disposed between a first substrate 1*a* and a second substrate 1*b* so as to hold a constant spacing therebetween and partitions each of three pixels G1, G2 and G3. In each of closed containers defined by the substrates 1*a* and 1*b* and the partition wall 7, migration particles (first particles 3*a* and second particles 3*b*) of two types having different charge polarities and colors and a dispersion medium 2 are filled and sealed.

In this embodiment, a part of the first electrode 4 is disposed along a surface (side face) of the partition wall 7 so as to be close to the second electrode 5. More specifically, in this embodiment, the first and second electrodes 4 and 5 are disposed so that a distance therebetween becomes minimum at a partition wall portion located at a side surface of each pixel. Thus, by making the distance between the first electrode surface and the second electrode surface minimum at the partition wall portion, when an AC voltage is applied, a non-uniform electric field distribution is created in pixel and as shown in FIG. 2, it is possible to form a strong electric field area (area A) in such an area that the distance between the first electrode surface and the second electrode surface becomes minimum. By doing so, the migration particles can be collected at the side surface of pixel, so that the resultant state can be used as a display state.

In First Embodiment described above, an electric field strength becomes a maximum at a center of pixel, so that the migration particles are collected at one point. In this embodiment, however, the migration particles are collected along the periphery of pixel, so that a pixel area viewed in a direction perpendicular to a display surface becomes narrow in the collected state. As a result, an effective area (aperture ratio) in this state is increased.

In FIG. 2, on the first electrode 4, coloring layers 9*a*, 9*b* and 9*c* are formed and under the coloring layers 9*a*, 9*b* and 9*c*, a directive scattering plate 10 is disposed. In the case where colors of the coloring layers 9*a*, 9*b* and 9*c* disposed on the first substrate are displayed, by providing such a directive scattering plate 10, it is possible to prevent light scattered from the coloring layers 9*a*, 9*b* and 9*c* from impinging on the migration particles to be lost before reaching the second substrate.

Here, the distance scattering plate 10 is prepared by forming the first electrode 4 of a high-reflectance metal and forming an unevenness, which is directively designed so that the light incident on the first electrode 4 is collected on the second substrate side, at the first electrode surface. In other words, the first electrode 4 also functions as the directive scattering plate 10.

Further, the partition wall 7 is formed such that a width thereof becomes narrower on a side where it contacts the second substrate 1*b*, whereby it is possible to increase an accommodation volume when the migration particles are collected in the strong electric field area (area A). As a result, it is possible to increase an aperture ratio of the coloring layers 9*a*, 9*b* and 9*c* to improve a contrast.

In this embodiment, e.g., the first particles 3*a* are positively charged black particles and the second particles 3*b* are negatively charged white particles. These two types of the migration particles 3*a* and 3*b* and the dispersion medium 2 have relative dielectric constants satisfying the relationship of (relative dielectric constant of migration particles (3*a*, 3*b*)>relative dielectric constant of dispersion medium 2). Further, e.g., the coloring layer 9*a* of the first pixel G1 is a red layer, the coloring layer 9*b* of the second pixel G2 is a green layer, and the coloring layer 9*c* of the third pixel G3 is a blue layer.

Then, a display method (drive method) for the electrophoretic display device having the above described constitution will be explained.

At the first pixel G1, when the second electrode 5 as a common electrode is grounded to 0 V and a desired voltage, e.g., a DC voltage of −10 V is applied to the first electrode 4, the positively charged black first particles 3*a* are moved to the first electrode surface, and the negatively charged white second particles 3*b* are moved to the second electrode surface. As a result, the color of the white second particles 3*b* is observed by a viewer on the second substrate side. In other words, the first pixel G1 is placed in the white display state.

At the second pixel G2, to the contrary, when a DC voltage of +10 V is applied to the first electrode 4, the positively charged black first particles 3*a* are moved to the second electrode surface, and the negatively charged white second particles 3*b* are moved to the first electrode surface. As a result, the color of the black first particles 3*a* is observed by the viewer on the second substrate side. In other words, the second pixel G2 is placed in the black display state.

Further, at the third pixel G3, when an AC voltage of ±10 V is applied to the first electrode 4, both of the first particles 3*a* and the second particles 3*b* are moved in the strong electric field area (area A) in the pixel. As a result, the color of the blue (coloring) layer 9*c* is principally observed by the viewer on the second substrate side. In other words, the third pixel G3 is placed in the blue display state.

As described above, at each of the pixels G1, G2 and G3, a total of three colors including the colors of the two types of the particles 3*a* and 3*b* and the color of the coloring layer 9*a*, 9*b* or 9*c* can be displayed.

Next, an example of a color display method at one pixel of the electrophoretic display device of this embodiment will be described with reference to FIGS. 3(*a*) to 3(*d*) with respect to cases of white, monochromatic color, complementary color, and black, respectively.

Figure 3:
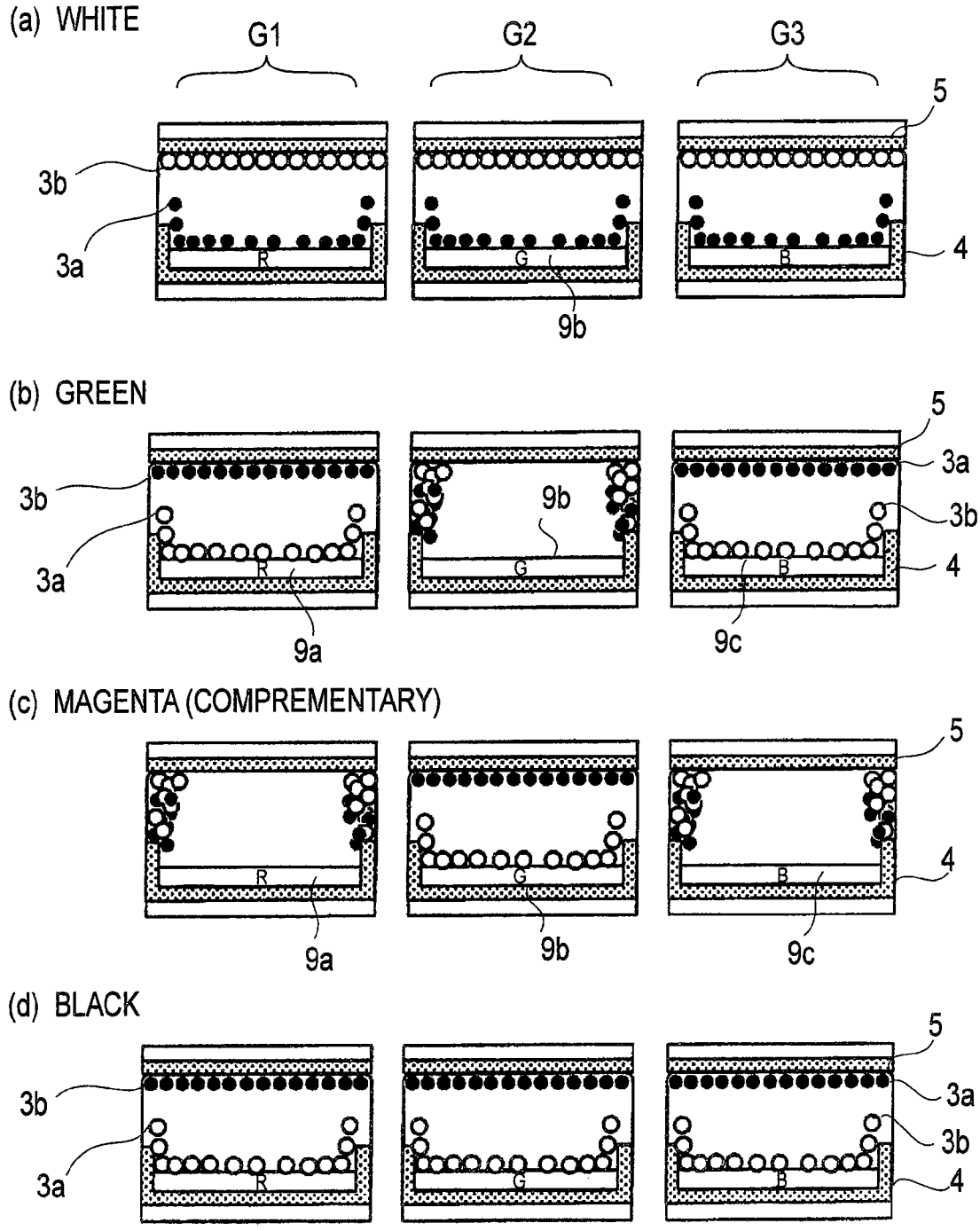
FIGS. 3(*a*) to 3(*d*) are schematic views for illustrating a color display method (driving method) for the electrophoretic display device shown in FIG. 2.

In the case of white display, as shown in FIG. 3(*a*), at all the pixels G1 to G3, the white second particles 3*b* are collected on the second electrode 5 and the black first particles 3*a* are collected on the first electrode 4. As a result, incident light is completely scattered by the white second particles 3*b* to effect white display.

In the case of monochromatic display of red, green or blue, e.g., in the case of green display, as shown in FIG. 3(*b*), the white second particles 3*b* and the black first particles 3*a* are collected in the strong electric field area (area A) at the second pixel G2 by applying an AC voltage to the first electrode 4, whereby a green (coloring) layer 9*b* is exposed. Further, at the first pixel G1 and the third pixel G3, the black first particles 3*a* are collected on the second electrode 5 to block light-transmission to a red layer 9*a* and a blue layer 9*c*. As a result, incident light assumes green by a green light flux (component) which is directively scattered at the second pixel G2.

In the case of complementary display of cyan, magenta or yellow, e.g., in the case of magenta display as shown in FIG. 3(*c*), the black first particles 3*a* are collected on the second electrode 5 at the second pixel G2 to block light transmission to the green layer 9*b*. Further, at the first pixel G1 and the third pixel G3, and AC voltage is applied to the first electrode 4, whereby the white second particles 3*b* and the black first particles 3*a* are collected in the strong electric field area (area A) to expose the red layer 9*a* and the blue layer 9*c*. As a result, incident light assumes magenta by additive color mixture of a red light flux which is directively scattered at the first pixel G1 and a blue light flux which is directively scattered at the third pixel G3.

In the case of black display, as shown in FIG. 3(*d*), at all the pixels G1 to G3, the black first particles 3*a* are collected on the second electrode 5 and the white second particles 3*b* are collected on the first electrode 4. As a result, incident light is absorbed by the black first particles 3*a* to effect black display.

As described above, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b* with the color of the coloring layer 9*a*, 9*b* or 9*c*. In this embodiment, a part of the first electrode 4 is disposed at a position of the partition wall 7, i.e., at the surface of or within the partition wall 7, so as to provide the strong electric field area. However, in addition to the first electrode 4, it is also possible to dispose a part of the second electrode 5 or a part of both of the first and second electrodes 4 and 5 at a position of the partition wall 7, i.e., at the surface of or within the partition wall 7.

Further, in the foregoing description, in order to electrophoretically move the two types of migration particles 3*a* and 3*b* having different charge polarities, the relationship of (relative dielectric constants of two types of migration particles) >(relative dielectric constant of dispersion medium) is satisfied but the relationship of (relative dielectric constants of two types of migration particles)<(relative dielectric constant of dispersion medium) may be satisfied.

Third Embodiment

Next, Third Embodiment of the present invention will be described.

Figure 4:
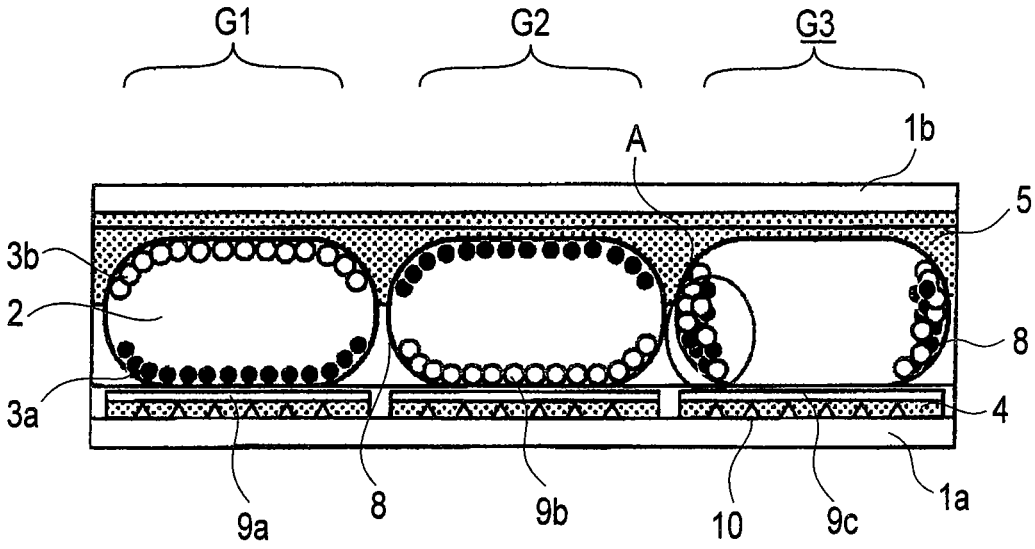
FIG. 4 is a schematic view showing a structure of an electrophoretic display device provided to an electrophoretic display apparatus, capable of effecting color display, according to Third Embodiment of the present invention.

FIG. 4 is a schematic structural view of an electrophoretic display device provided in an electrophoretic display apparatus capable of effecting color display according to this embodiment. In FIG. 4, members or portions indicated by the same reference numerals as in FIG. 2 represent the same or corresponding members or portions.

Referring to FIG. 4, transparent microcapsules 8 each containing migration particles (first particles 3*a* and second particles 3*b*) of two types having different charge polarities and colors and a dispersion medium 2 are disposed between a first substrate 1*a* and a second substrate 1*b*. In this embodiment, each closed container is constituted by a microcapsule.

In this embodiment, as shown in FIG. 4, a part of a second electrode 5 is extended and formed along the surface of microcapsule so as to be close to a first electrode 4 side. By doing so, a distance between the first electrode surface and the second electrode surface becomes minimum at a side surface of microcapsule. Further, by forming the second electrode 5 as described above, it is possible to provide a non-uniform electric field distribution in pixel. Further, it is possible to form a strong electric field area (area A) in such an area that the distance between the first electrode surface and the second electrode-surface becomes minimum.

Hereinafter, a display method (drive method) for the electrophoretic display device having the above described constitution will be explained.

At the first pixel G1, when the second electrode 5 as a common electrode is grounded to 0 V and a desired voltage, e.g., a DC voltage of −10 V is applied to the first electrode 4, the positively charged black first particles 3*a* are moved to the first electrode surface, and the negatively charged white second particles 3*b* are moved to the second electrode surface. As a result, the color of the white second particles 3*b* is observed by a viewer on the second substrate side. In other words, the first pixel G1 is placed in the white display state.

At the second pixel G2, to the contrary, when a DC voltage of +10 V is applied to the first electrode 4, the positively charged black first particles 3*a* are moved to the second electrode surface, and the negatively charged white second particles 3*b* are moved to the first electrode surface. As a result, the color of the black first particles 3*a* is observed by the viewer on the second substrate side. In other words, the second pixel G2 is placed in the black display state.

Further, at the third pixel G3, when an AC voltage of ±10 V is applied to the first electrode 4, both of the first particles 3*a* and the second particles 3*b* are moved in the strong electric field area (area A) in the pixel. As a result, the color of the blue (coloring) layer 9*c* is principally observed by the viewer on the second substrate side. In other words, the third pixel G3 is placed in the blue display state.

As described above, also in this embodiment, at each of the pixels G1, G2 and G3, a total of three colors including the colors of the two types of the particles 3*a* and 3*b* and the color of the coloring layer 9*a*, 9*b* or 9*c* can be displayed.

Next, an example of a color display method at one pixel of the electrophoretic display device of this embodiment will be described with reference to FIGS. 5(*a*) to 5(*d*) with respect to cases of white, monochromatic color, complementary color, and black, respectively.

Figure 5:
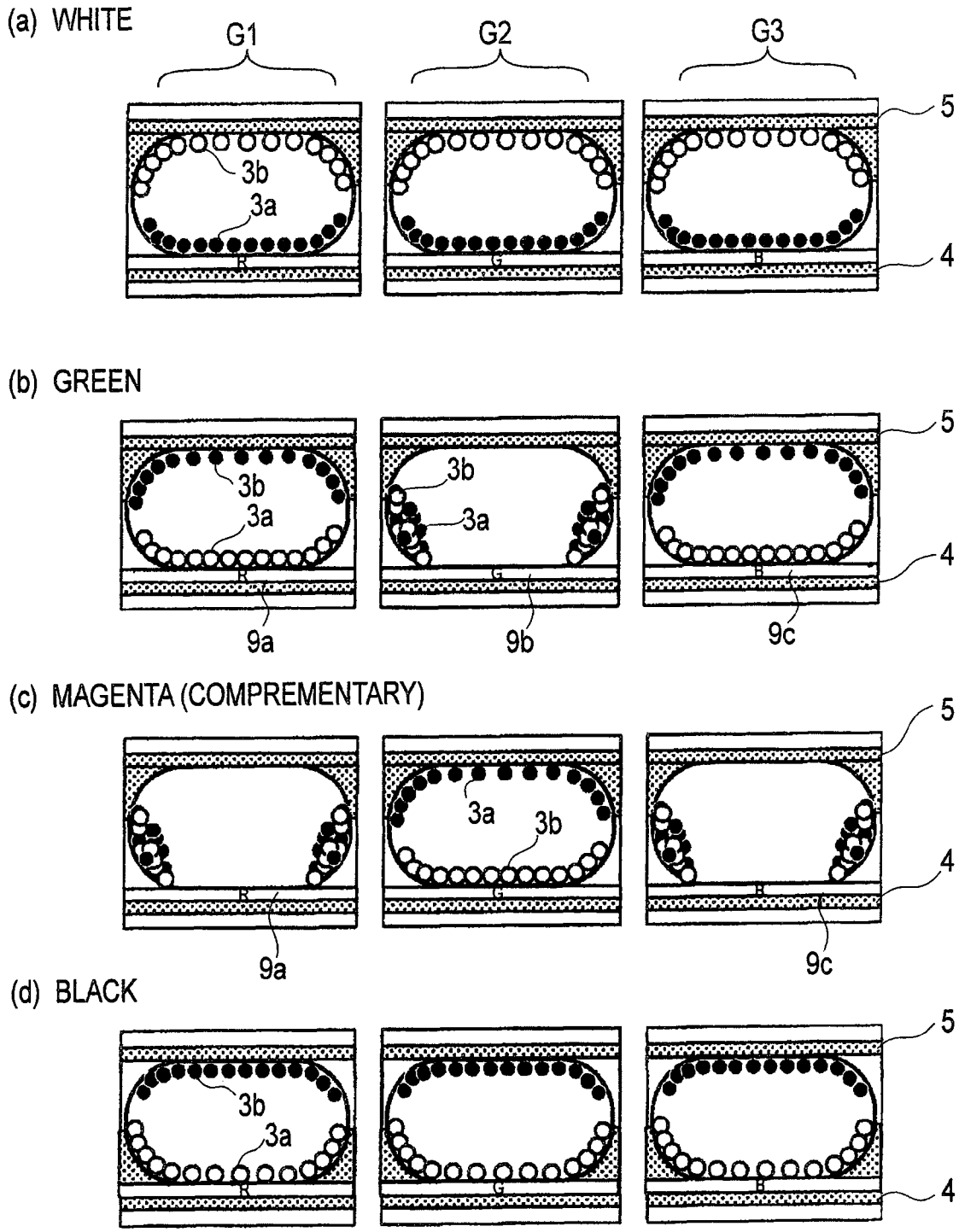
FIGS. 5(*a*) to 5(*d*) are schematic views for illustrating a color display method (driving method) for the electrophoretic display device shown in FIG. 3.

In the case of white display, as shown in FIG. 5(*a*), at all the pixels G1 to G3, the white second particles 3*b* are collected on the second electrode 5 and the black first particles 3*a* are collected on the first electrode 4. As a result, incident light is completely scattered by the white second particles 3*b* to effect white display.

In the case of monochromatic display of red, green or blue, e.g., in the case of green display, as shown in FIG. 5(*b*), the white second particles 3*b* and the black first particles 3*a* are collected in the strong electric field area (area A) at the second pixel G2 by applying an AC voltage to the first electrode 4, whereby a green (coloring) layer 9*b* is exposed. Further, at the first pixel G1 and the third pixel G3, the black first particles 3*a* are collected on the second electrode 5 to block light transmission to a red layer 9*a* and a blue layer 9*c*. As a result, incident light assumes green by a green light flux (component) which is directively scattered at the second pixel G2.

In the case of complementary display of cyan, magenta or yellow, e.g., in the case of magenta display as shown in FIG. 5(*c*), the black first particles 3*a* are collected on the second electrode 5 at the second pixel G2 to block light transmission to the green layer 9*b*. Further, at the first pixel G1 and the third pixel G3, and AC voltage is applied to the first electrode 4, whereby the white second particles 3*b* and the black first particles 3*a* are collected in the strong electric field area (area A) to expose the red layer 9*a* and the blue layer 9*c*. As a result, incident light assumes magenta by additive color mixture of a red light flux which is directively scattered at the first pixel G1 and a blue light flux which is directively scattered at the third pixel G3.

In the case of black display, as shown in FIG. 5(*d*), at all the pixels G1 to G3, the black first particles 3*a* are collected on the second electrode 5 and the white second particles 3*b* are collected on the first electrode 4. As a result, incident light is absorbed by the black first particles 3*a* to effect black display.

As described above, also in this embodiment, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b* with the color of the coloring layer 9*a*, 9*b* or 9*c*.

In the microcapsules used in this embodiment, in addition to such a conventional vertical movement that the migration particles are vertically moved between electrodes formed on the upper and lower substrates, respectively, it becomes also possible to effect horizontal movement without changing the number of the electrodes.

Fourth Embodiment

Next, Fourth Embodiment of the present invention will be described.

Figure 6:
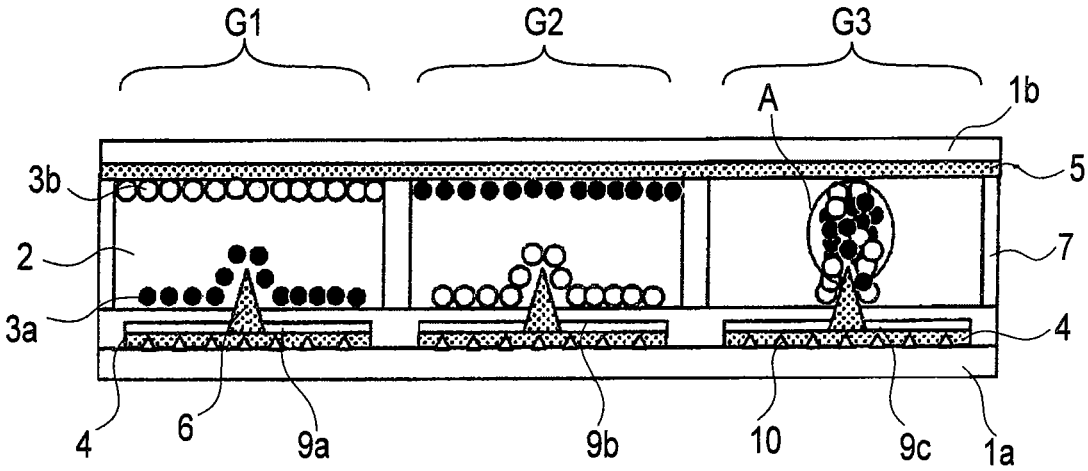
FIG. 6 is a schematic view showing a structure of an electrophoretic display device provided to an electrophoretic display apparatus, capable of effecting color display, according to Fourth Embodiment of the present invention.

FIG. 6 is a schematic structural view of an electrophoretic display device provided in an electrophoretic display apparatus capable of effecting color display according to this embodiment. In FIG. 6, members or portions indicated by the same reference numerals as in FIG. 2 represent the same or corresponding members or portions.

Referring to FIG. 6, a projection-like electrode surface 6 is formed at a center portion of a first electrode 4, whereby it is possible to form (create) a strong electric field area, as a non-uniform electric field distribution, between the (projection-like) electrode surface of the first electrode 4 and the electrode surface of the second electrode 5.

Incidentally, in this embodiment, e.g., the coloring layer 9*a* of the first pixel G1 is a cyan layer, the coloring layer 9*b* of the second pixel G2 is a magenta layer, and the coloring layer 9*c* of the third pixel G3 is a yellow layer.

Then, a display method (drive method) for the electrophoretic display device having the above described constitution will be explained.

At the first pixel G1, when the second electrode 5 as a common electrode is grounded to 0 V and a desired voltage, e.g., a DC voltage of −10 V is applied to the first electrode 4, the positively charged black first particles 3*a* are moved to the first electrode surface, and the negatively charged white second particles 3*b* are moved to the second electrode surface. As a result, the color of the white second particles 3*b* is observed by a viewer on the second substrate side. In other words, the first pixel G1 is placed in the white display state.

At the second pixel G2, to the contrary, when a DC voltage of +10 V is applied to the first electrode 4, the positively charged black first particles 3*a* are moved to the second electrode surface, and the negatively charged white second particles 3*b* are moved to the first electrode surface. As a result, the color of the black first particles 3*a* is observed by the viewer on the second substrate side. In other words, the second pixel G2 is placed in the black display state.

Further, at the third pixel G3, when an AC voltage of ±10 V is applied to the first electrode 4, both of the first particles 3*a* and the second particles 3*b* are moved in the strong electric field area (area A) in the pixel. As a result, the color of the yellow (coloring) layer 9*c* is principally observed by the viewer on the second substrate side. In other words, the third pixel G3 is placed in the yellow display state.

As described above, also in this embodiment, at each of the pixels G1, G2 and G3, a total of three colors including the colors of the two types of the particles 3*a* and 3*b* and the color of the coloring layer 9*a*, 9*b* or 9*c* can be displayed.

Next, an example of a color display method at one pixel of the electrophoretic display device of this embodiment will be described with reference to FIGS. 7(*a*) to 7(*d*) with respect to cases of white, monochromatic color, complementary color, and black, respectively.

Figure 7:
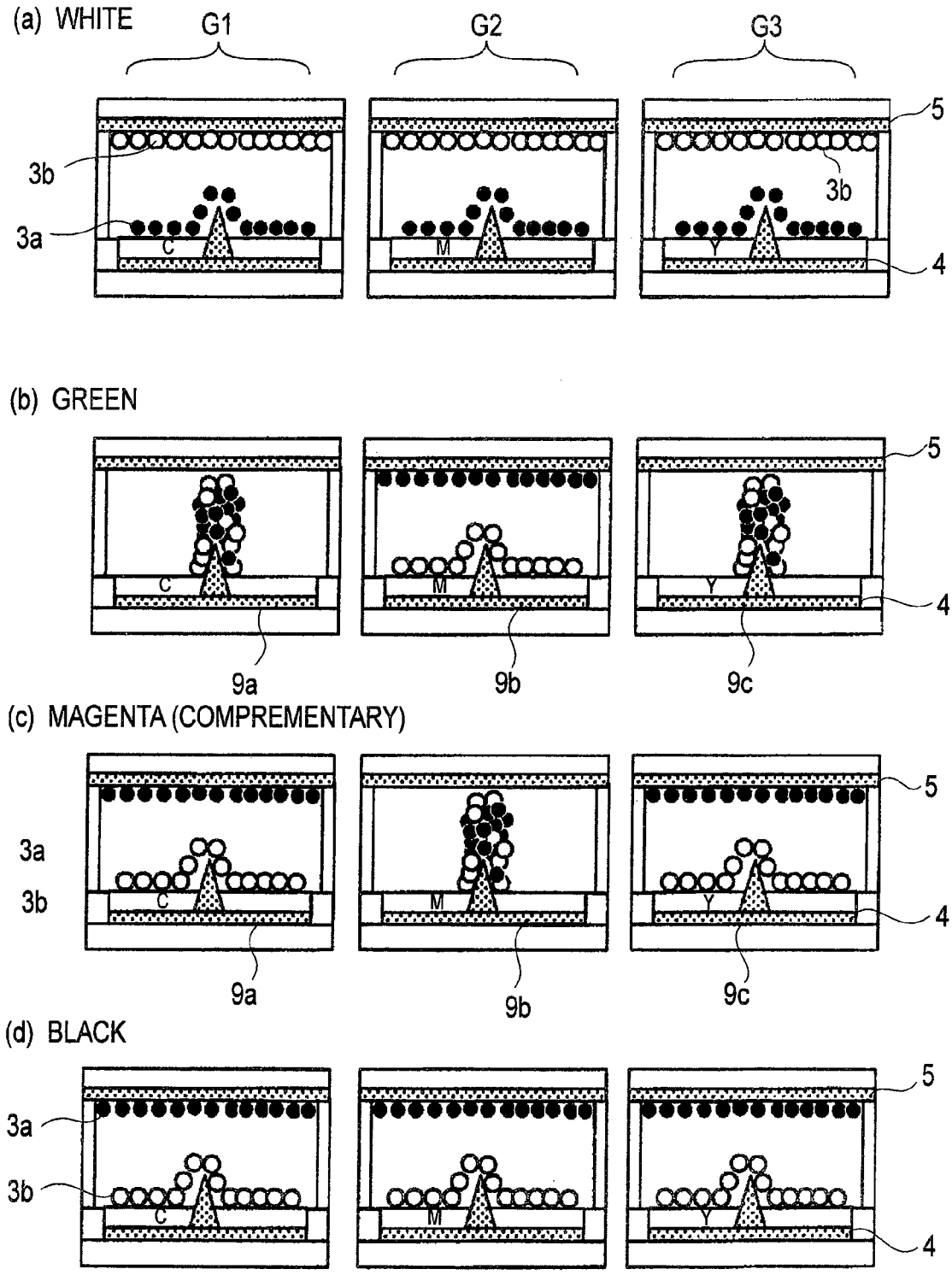
FIGS. 7(*a*) to 7(*d*) are schematic views for illustrating a color display method (driving method) for the electrophoretic display device shown in FIG. 6.

In the case of white display, as shown in FIG. 7(*a*), at all the pixels G1 to G3, the white second particles 3*b* are collected on the second electrode 5 and the black first particles 3*a* are collected on the first electrode 4. As a result, incident light is completely scattered by the white second particles 3*b* to effect white display.

In the case of monochromatic display of red, green or blue, e.g., in the case of green display, as shown in FIG. 7(*b*), the white second particles 3*b* and the black first particles 3*a* are collected in the strong electric field area (area A) at the first pixel G1 and the third pixel G3 by applying an AC voltage to the first electrode 4, whereby a cyan (coloring) layer 9*a* and a yellow (coloring) layer 9*c* are exposed, respectively. Further, at the second pixel G2, the black first particles 3*a* are collected on the second electrode 5 to block light transmission to a magenta layer 9*b*. As a result, incident light assumes green by additive color mixture of a cyan light flux (component) which is directively scattered at the first pixel G1 and a yellow light flux (component) which is directively scattered at the third pixel G3.

In the case of complementary display of cyan, magenta or yellow, e.g., in the case of magenta display as shown in FIG. 7(*c*), the black first particles 3*a* are collected on the second electrode 5 at the first pixel G1 and the third pixel G3 to block light transmission to the cyan layer 9*a* and the yellow layer 9*c*.

Further, at the second pixel G2, an AC voltage is applied to the first electrode 4, whereby the white second particles 3*b* and the black first particles 3*a* are collected in the strong electric field area (area A) to expose the magenta layer 9*b*. As a result, incident light assumes magenta by a magenta light flux which is directively scattered at the second pixel G2.

In the case of black display, as shown in FIG. 7(*d*), at all the pixels G1 to G3, the black first particles 3*a* are collected on the second electrode 5 and the white second particles 3*b* are collected on the first electrode 4. As a result, incident light is absorbed by the black first particles 3*a* to effect black display.

As described above, also in this embodiment, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b* with the color of the coloring layer 9*a*, 9*b* or 9*c*.

Incidentally, in the foregoing description, the first particles 3*a* and the second particles 3*b* are disposed at each of all the pixels G1 to G3 but the present invention is not particularly limited thereto. It is also possible to dispose first and second particles 3*a* and 3*b* which are different in color for each pixel.

Fifth Embodiment

Next, an electrophoretic display apparatus capable of effecting color display according to Fifth Embodiment of the present invention will be described.

Figure 8:
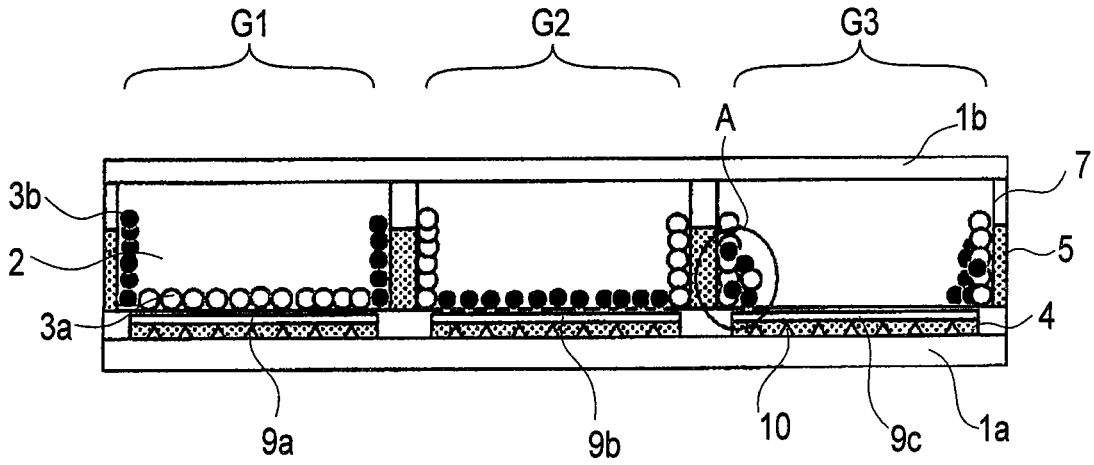
FIG. 8 is a schematic view showing a structure of an electrophoretic display device provided to an electrophoretic display apparatus, capable of effecting color display, according to Fifth Embodiment of the present invention.

FIG. 8 is a schematic structural view of an electrophoretic display device provided in an electrophoretic display apparatus capable of effecting color display according to this embodiment. In FIG. 8, members or portions indicated by the same reference numerals as in FIG. 2 represent the same or corresponding members or portions.

Referring to FIG. 8, a second electrode 5 is formed in a partition wall and is extended along the partition wall extension line so as to be close to a first electrode 4 as it is close to a first substrate. As a result, a distance between the first electrode surface and the second electrode surface becomes minimum at a partition wall portion at a pixel side surface, whereby a non-uniform electric field distribution is provided in each pixel. As a result, it is possible to form a strong electric field area (area A) in an area where the first electrode surface and the second electrode surface are closest to each other.

Further, in this embodiment, at a first pixel G1, positively charged black particles as first particles 3*a* and negatively charged red particles as second particles 3*b* are dispersed. At a second pixel G2, positively charged black particles as first particles 3*a* and negatively charged green particles as second particles 3*b* are dispersed and at a third pixel G3, positively charged black particles as first particles 3*a* and negatively charged blue particles as second particles 3*b* are dispersed. Incidentally, at each of the pixels G1 to G3, a relationship of (relative dielectric constants of two types of migration particles)>(relative dielectric constant of dispersion medium) is satisfied.

Further, the second electrode 5 is a common electrode for applying an identical voltage to all the pixels G1 to G3, and all coloring layers 9*a*, 9*b* and 9*c* disposed at the pixels G1, G2 and G3, respectively, are, e.g., a white layer in this embodiment.

Then, a display method (drive method) for the electrophoretic display device having the above described constitution will be explained.

At the first pixel G1, when the second electrode 5 as a common electrode is grounded to 0 V and a desired voltage, e.g., a DC voltage of +10 V is applied to the first electrode 4, the positively charged black first particles 3*a* are moved to the second electrode surface, and the negatively charged red second particles 3*b* are moved to the first electrode surface. As a result, the color of the red second particles 3*b* is principally observed by a viewer on the second substrate side. In other words, the first pixel G1 is placed in the red display state.

At the second pixel G2, to the contrary, when a DC voltage of −10 V is applied to the first electrode 4, the positively charged black first particles 3*a* are moved to the first electrode surface, and the negatively charged green second particles 3*b* are moved to the second electrode surface. As a result, the color of the black first particles 3*a* is principally observed by the viewer on the second substrate side. In other words, the second pixel G2 is placed in the black display state.

Further, at the third pixel G3, when an AC voltage of ±10 V is applied to the first electrode 4, both of the first particles 3*a* and the second particles 3*b* are moved in the strong electric field area (area A) in the pixel. As a result, the color of the white (coloring) layer 9*c* is principally observed by the viewer on the second substrate side. In other words, the third pixel G3 is placed in the white display state.

As described above, at each of the pixels G1, G2 and G3, a total of three colors including the colors of the two types of the particles 3*a* and 3*b* and the color of the coloring layer 9*a*, 9*b* or 9*c* can be displayed.

In the conventional electrophoretic display apparatus using only the electrophoretic force, the G3 state cannot be provided, so that a color filter is disposed on the upper second substrate 1*b* in order to effect color display. However, in this embodiment, in the white display state (G1), the white particles are directly observed, so that it is possible to effect bright white display. Further, in this embodiment, the color filter is disposed on the first substrate 1*a*, so that the upper second substrate 1*b* is not required to be provided with the color filter and it is not necessary to effect any additional processing. Further, the color filter may only be bonded to the first substrate without positional alignment at the time of bonding operation.

In this embodiment, as shown in FIG. 8, the electrode 5 is provided in the partition wall independent from the second substrate electrode 4, so that a non-uniform electric field is naturally created. As a result, it is not necessary to extend the substrate electrode along the partition wall as shown in FIG. 3, and it is also not necessary to provide a projection portion at a part of pixel as shown in FIG. 6.

Next, an example of a color display method at one pixel of the electrophoretic display device of this embodiment will be described with reference to FIGS. 9(*a*) to 9(*d*) with respect to cases of white, monochromatic color, complementary color, and black, respectively.

Figure 9:
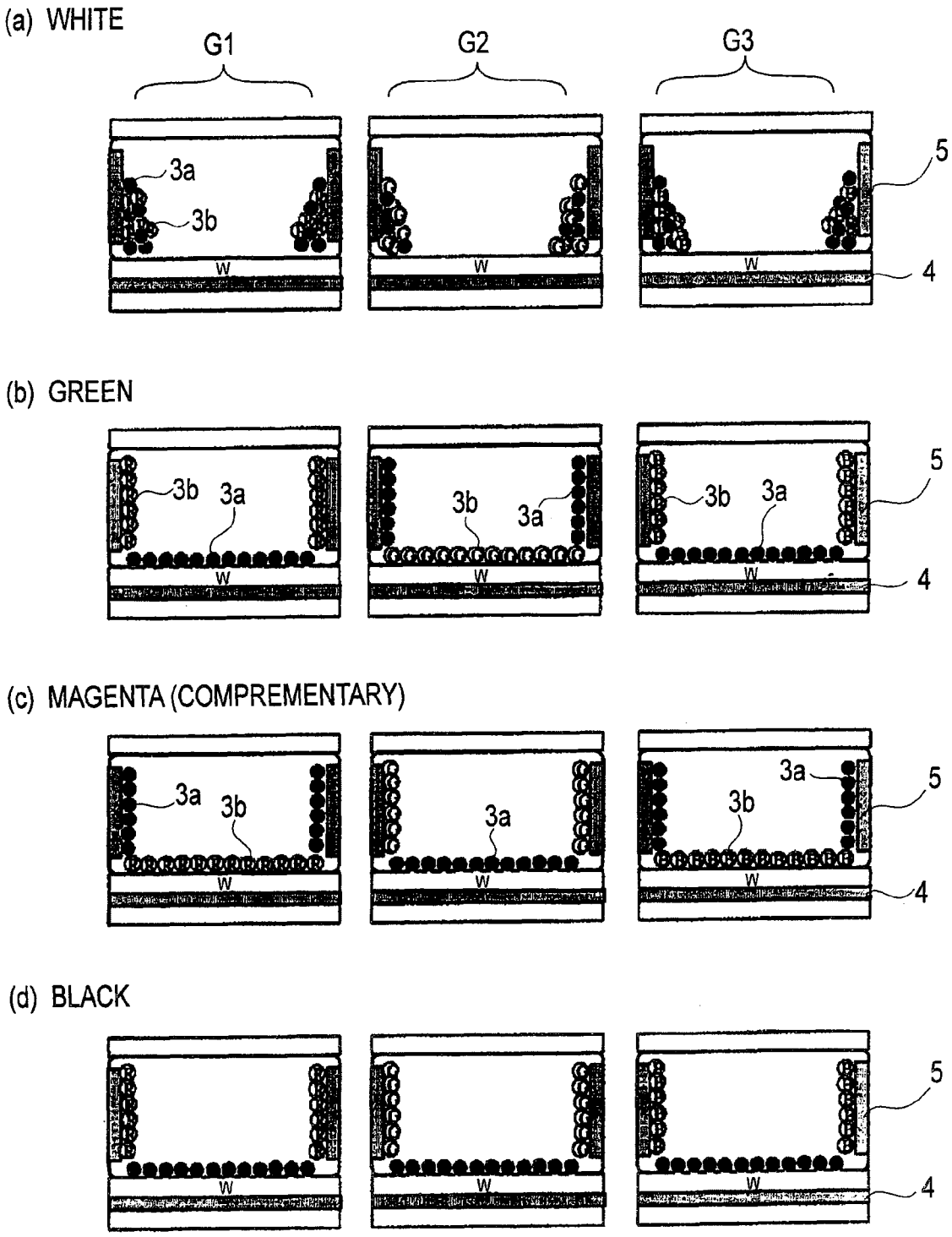
FIGS. 9(*a*) to 9(*d*) are schematic views for illustrating a color display method (driving method) for the electrophoretic display device shown in FIG. 8.

In the case of white display, as shown in FIG. 9(*a*), at all the pixels G1 to G3, the black first particles 3*a* and the second particles 3*b* of red, green or blue are collected in the strong electric field area (area A) by applying an AC voltage to the first electrode 4, whereby the white scattering layers 9*a*, 9*b* and 9*c* are exposed. As a result, incident light is directively scattered to effect bright white display.

In the case of monochromatic display of red, green or blue, e.g., in the case of green display, as shown in FIG. 9(*b*), at the first pixel G1 and the third pixel G3, the black first particles 3*a* are collected on the first electrode 4 to block light transmission of the white scattering layers 9*a* and 9*c*. Further, at the second pixel G2, the green first particles 3*a* are collected on the first electrode 4. As a result, incident light assumes green by a green light flux (component) which is scattered at the second pixel G2.

In the case of complementary display of cyan, magenta or yellow, e.g., in the case of magenta display as shown in FIG. 9(*c*), the black first particles 3*a* are collected on the second electrode 5 at the second pixel G2 to block light transmission to the white scattering layer 9*b*. Further, at the first pixel G1, the red first particles 3*a* are collected on the first electrode 4 and at the third pixel G3, the blue first particles 3*a* are collected on the first electrode 4. As a result, incident light assumes magenta by addition color mixture of a red light flux scattered at the first pixel G1 and a blue light flux scattered at the third pixel G3.

In the case of black display, as shown in FIG. 9(*d*), at all the pixels G1 to G3, the black first particles 3*a* are collected on the first electrode 4 to block light transmission to the white scattering layers 9*a*, 9*b* and 9*c*. As a result, incident light is absorbed by the black first particles 3*a* to effect black display.

As described above, also in this embodiment, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b* with the color of the coloring layer 9*a*, 9*b* or 9*c*.

Sixth Embodiment

Next, Sixth Embodiment of the present invention will be described.

Figure 10:
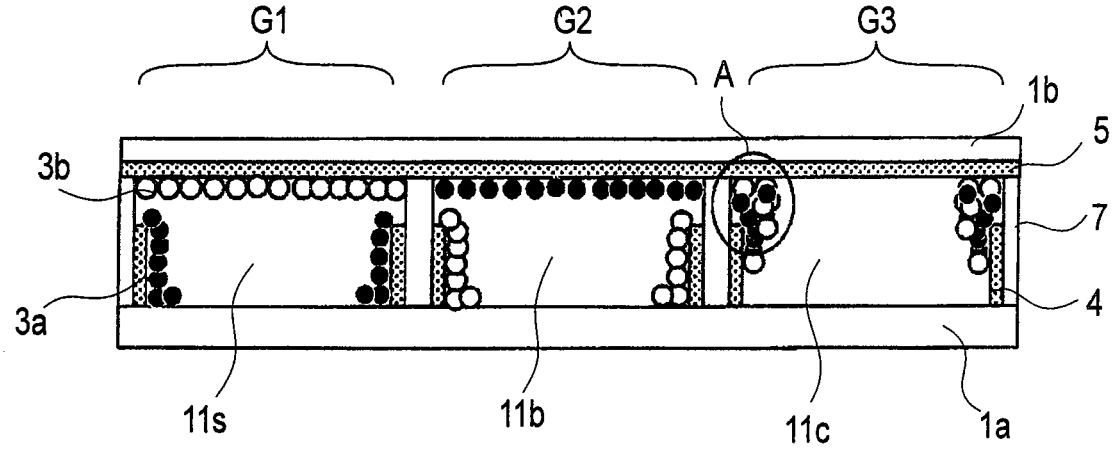
FIG. 10 is a schematic view showing a structure of an electrophoretic display device provided to an electrophoretic display apparatus, capable of effecting color display, according to Sixth Embodiment of the present invention.

FIG. 10 is a schematic structural view of an electrophoretic display device provided in an electrophoretic display apparatus capable of effecting color display according to this embodiment. In FIG. 10, members or portions indicated by the same reference numerals as in FIG. 2 represent the same or corresponding members or portions.

Referring to FIG. 10, each of color dispersion mediums 11*a*, 11*b* and 11*c* is filled (sealed) in a closed container formed by the substrates 1*a* and 1*b* and the partition wall 7 and in each medium, migration particles (first particles 3*a* and second particles 3*b*) of two types having different charge polarities and colors are dispersed. These dispersion mediums 11*a*, 11*b* and 11*c* are colored different colors at pixels G1, G2 and G3, respectively. Incidentally, in this embodiment, e.g., the dispersion medium 11*a* at the first pixel G1 is colored red (R), the dispersion medium 11*b* at the second pixel G2 is colored green (G), and the dispersion medium 11*c* at the third pixel G3 is colored blue (B).

Further, in this embodiment, a first electrode 4 is formed on a side surface of the partition wall 7. As a result, a distance between the first electrode surface and the second electrode surface becomes minimum at a partition wall portion at a pixel side surface, whereby a non-uniform electric field distribution is provided in each pixel. As a result, it is possible to form a strong electric field area (area A) in an area where the first electrode surface and the second electrode surface are closest to each other.

Then, a display method (drive method) for the electrophoretic display device having the above described constitution will be explained.

At the first pixel G1, when the second electrode 5 as a common electrode is grounded to 0 V and a desired voltage, e.g., a DC voltage of −10 V is applied to the first electrode 4, the positively charged black first particles 3*a* are moved to the first electrode surface, and the negatively charged white second particles 3*b* are moved to the second electrode surface. As a result, the color of the white second particles 3*b* is principally observed by a viewer on the second substrate side. In other words, the first pixel G1 is placed in the white display state.

At the second pixel G2, to the contrary, when a DC voltage of +10 V is applied to the first electrode 4, the positively charged black first particles 3*a* are moved to the second electrode surface, and the negatively charged white second particles 3*b* are moved to the first electrode surface. As a result, the color of the black first particles 3*a* is principally observed by the viewer on the second substrate side. In other words, the second pixel G2 is placed in the black display state.

Further, at the third pixel G3, when an AC voltage of ±10 V is applied to the first electrode 4, both of the first particles 3*a* and the second particles 3*b* are moved in the strong electric field area (area A) in the pixel. As a result, the color of the blue dispersion medium 11*c* is principally observed by the viewer on the second substrate side. In other words, the third pixel G3 is placed in the blue display state.

As described above, at each of the pixels G1, G2 and G3, a total of three colors including the colors of the two types of the particles 3*a* and 3*b* and the color of the dispersion medium 11*a*, 11*b* or 11*c* can be displayed.

Next, an example of a color display method at one pixel of the electrophoretic display device of this embodiment will be described with reference to FIGS. 11(*a*) to 11(*d*) with respect to cases of white, monochromatic color, complementary color, and black, respectively.

Figure 11:
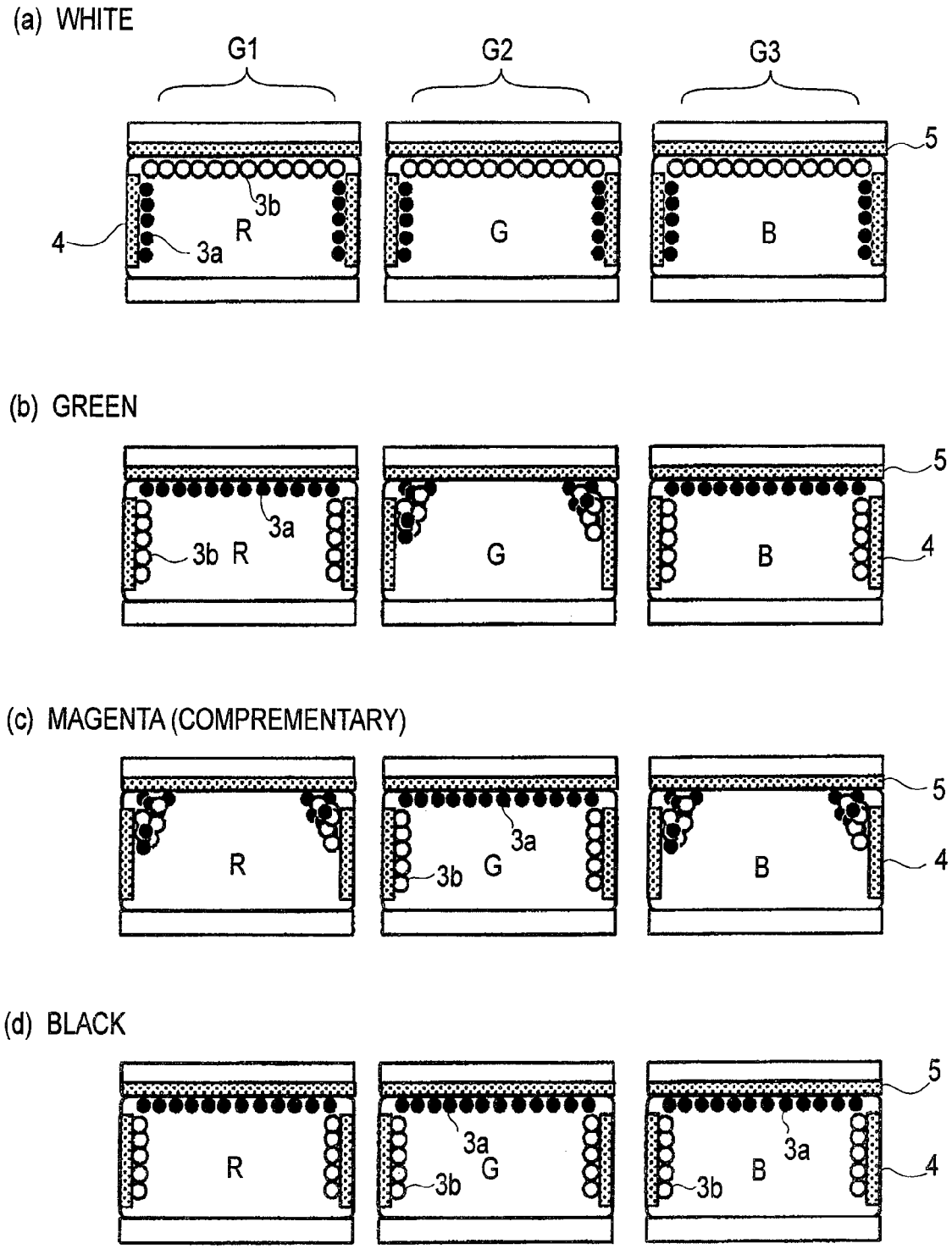
FIGS. 11(*a*) to 11(*d*) are schematic views for illustrating a color display method (driving method) for the electrophoretic display device shown in FIG. 10.

In the case of white display, as shown in FIG. 11(*a*), at all the pixels G1 to G3, the white second particles 3*b* are collected on the second electrode 5 and the black first particles 3*a* are collected on the first electrode 4. As a result, incident light is completely scattered by the white second particles 3*b* to effect bright white display.

In the case of monochromatic display of red, green or blue, e.g., in the case of green display, as shown in FIG. 11(*b*), at the first pixel G1 and the third pixel G3, the black first particles 3*a* are collected on the third electrode 5 to block light transmission of the red and blue dispersion mediums 11*a* and 11*c*. Further, at the second pixel G2, the white third particles 3*b* and the black first particles 3*a* are collected in the strong electric field area (area A) to expose the green dispersion medium 11. As a result, incident light assumes green by a green light flux (component) which is scattered at the second pixel G2.

In the case of complementary display of cyan, magenta or yellow, e.g., in the case of magenta display as shown in FIG. 11(*c*), at the first pixel G1 and the third pixel G3, the white third particles 3*b* and the black first particles 3*a* are collected in the strong electric field area (area A) by applying an AC voltage to the first electrode 4, whereby the red and blue dispersion mediums are exposed. Further, at the third pixel G2, the black first particles 3*a* are collected on the second electrode 5 to block light transmission to the green dispersion medium 11*b*. As a result, incident light assumes magenta by addition color mixture of a red light flux scattered at the first pixel G1 and a blue light flux scattered at the third pixel G3.

In the case of black display, as shown in FIG. 11(*d*), at all the pixels G1 to G3, the black first particles 3*a* are collected on the second electrode 5 and the white second particles 3*b* are collected on the first electrode 1. As a result, incident light is absorbed by the black first particles 3*a* to effect black display.

As described above, also in this embodiment, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b* with the color of the dispersion medium 11*a*, 11*b* or 11*c*.

Seventh Embodiment

Incidentally, in the foregoing description, the first electrode 4 and the second electrode 5 are disposed at one pixel. However, in the present invention, a third electrode as another electrode is disposed and light transmissive migration particles are employed, whereby it is possible to display a total of four colors at one pixel.

Seventh Embodiment

Next, Seventh Embodiment of the present invention will be described.

Figure 12:
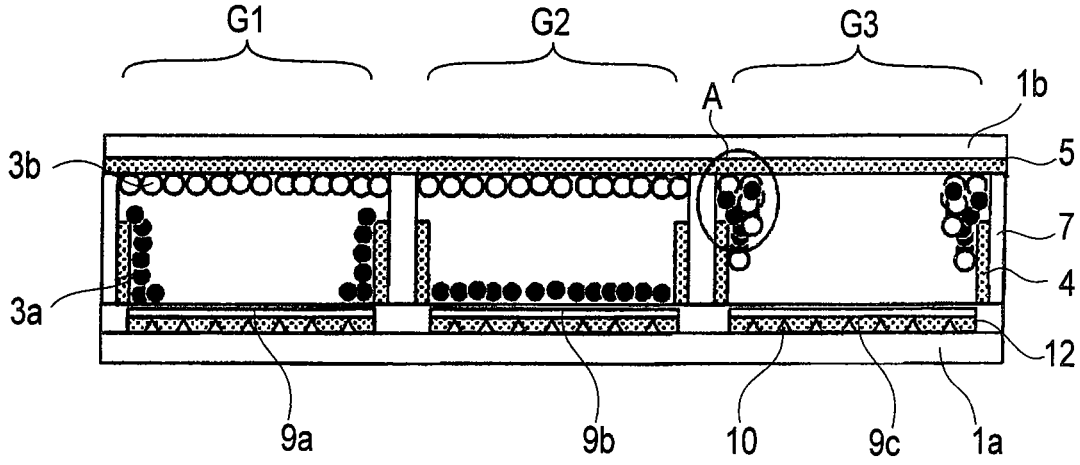
FIG. 12 is a schematic view showing a structure of an electrophoretic display device provided to an electrophoretic display apparatus, capable of effecting color display, according to Seventh Embodiment of the present invention.

FIG. 12 is a schematic structural view of an electrophoretic display device provided in an electrophoretic display apparatus capable of effecting color display according to this embodiment. In FIG. 8, members or portions indicated by the same reference numerals as in FIG. 10 represent the same or corresponding members or portions.

Referring to FIG. 12, a third electrode 12 is formed on the first substrate 1*a* and functions as a directive scattering plate 10. On the third electrode 12, a coloring layer 9*a*, 9*b* and 9*c* is formed. Incidentally, in this embodiment, the first electrode 4 is formed along a (side) surface of the partition wall 7 and is independent for each pixel. The second electrode 5 is formed on the second substrate 1*b*, as a common electrode, for applying an identical voltage at all the pixels G1 to G3.

Further, in this embodiment, at a first pixel G1, positively charged light transmissive blue particles as first particles 3*a* and negatively charged light transmissive yellow particles as second particles 3*b* are dispersed. At a second pixel G2, positively charged light transmissive green particles as first particles 3*a* and negatively charged light transmissive magenta particles as second particles 3*b* are dispersed and at a third pixel G3, positively charged light transmissive red particles as first particles 3*a* and negatively charged light transmissive cyan particles as second particles 3*b* are dispersed. Incidentally, at each of the pixels G1 to G3, a relationship of (relative dielectric constants of two types of migration particles)>(relative dielectric constant of dispersion medium) is satisfied.

Further, all coloring layers 9*a*, 9*b* and 9*c* disposed at the pixels G1, G2 and G3, respectively, are, e.g., a white layer in this embodiment.

Then, at one pixel, a display method (drive method) for the electrophoretic display device having the above described constitution will be explained.

Figure 13:
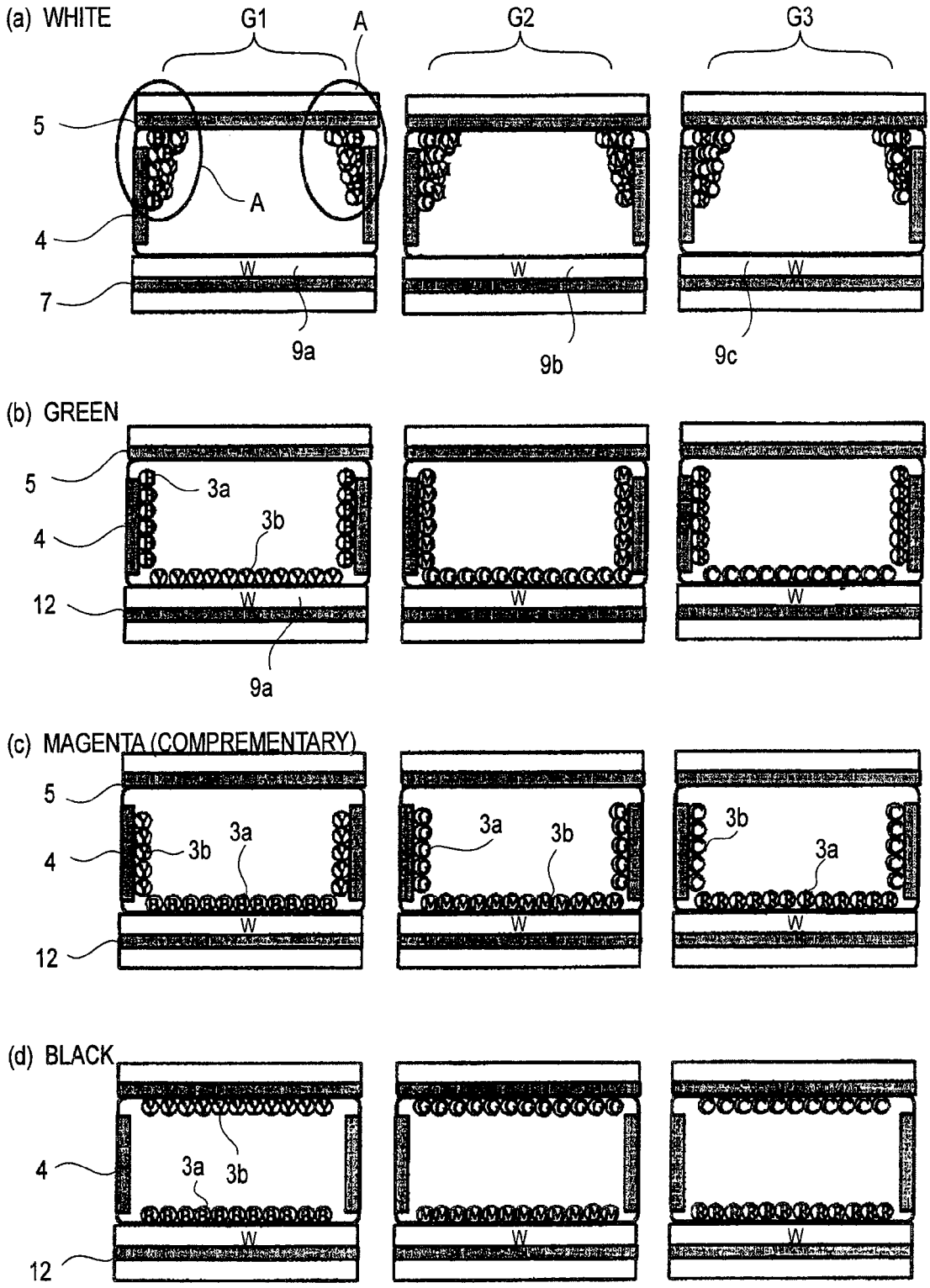
FIGS. 13(*a*) to 13(*d*) are schematic views for illustrating a color display method (driving method) for the electrophoretic display device shown in FIG. 12.

At the first pixel G1, when the second electrode 5 as a common electrode is grounded to 0 V and desired voltages, e.g., including a DC voltage of −5 V and a DC voltage of +10 V are applied to the first electrode 4, and the third electrode 12, respectively, the positively charged blue first particles 3*a* are moved to the first electrode surface, and the negatively charged yellow second particles 3*b* are moved to the third electrode surface as shown in FIG. 13(*b*). As a result, the color of the red second particles 3*b* is principally observed by a viewer on the second substrate side. In other words, the first pixel G1 is placed in the yellow display state.

Incidentally, in this case, the yellow second particles 3*b* are light transmissive particles, so that light passed through the second particles is scattered by the white (coloring) layer 9*a* and then is passed through again the yellow second particles 3*b*. As a result, a further bright yellow display state is observed.

At the first pixel G1, to the contrary, when a DC voltage of +5 V and a DC voltage of −10 V is applied to the first electrode 4 and the third electrode 12, respectively, the positively charged blue first particles 3*a* are moved to the third electrode surface, and the negatively charged yellow second particles 3*b* are moved to the first electrode surface as shown in FIG. 13(*c*). As a result, the color of the blue first particles 3*a* is principally observed by the viewer on the second substrate side. In other words, the first pixel G1 is placed in the blue display state.

Further, thereafter, when a DC voltage of −5 V is applied to the first electrode 4 and a DC voltage of −10 V is applied to the third electrode 12, as shown in FIG. 13(*d*), the positively charged blue first particles 3*a* are moved to the third electrode surface and the negatively charged yellow second particles 3*b* are moved to the second electrode surface. As a result, the display color created by subtractive color mixture of the light transmissive first particles 3*a* and the second particles 3*b* is observed. In this case, the black is displayed by the subtractive color mixture of the blue first particles 3*a* and the yellow second particles 3*b* providing a mutual complementary color relationship.

Further, an AC voltage of ±10 V is applied to the first electrode 4 and an AC voltage of ±10 V is similarly applied to the third electrode 12. In other words, an electrically identical voltage is applied to the first electrode 4 and the third electrode 12. Here, as described above, the first electrode 4 and the third electrode 12 are electrodes to which the identical-voltage is applied and an AC voltage is applied to these first and third electrodes 4 and 12, whereby a non-uniform electric field distribution is created in each pixel to provide a strong electric field area (area A) in such an area where a distance between the first electrode surface and the third electrode surface is smallest. As a result, as shown in FIG. 13(*a*), both the first particles 3*a* and the second particles 3*b* are moved in the strong electric field area (area A) in pixel, so that the color of the white (coloring) layer 9*a* is principally observed. In other words, in this case, a white display state is provided.

By driving the electrophoretic display apparatus as described above, at each of the pixels G1, G2 and G3, a total of four colors including the colors of the two types of the particles 3*a* and 3*b*, the color of the coloring layer 9*a*, 9*b* or 9*c*, and the color of subtractive color mixture of the two types of the particles can be displayed.

Next, an example of a color display method at one pixel of the electrophoretic display device of this embodiment will be described with reference to FIGS. 13(*a*) to 13(*d*) with respect to cases of white, monochromatic color, complementary color, and black, respectively.

In the case of white display, as shown in FIG. 13(*a*), at all the pixels G1 to G3, the first particles 3*a* (the first pixel G1: blue particles, the second pixel G2: green particles, and the third pixel G3: red particles) and the second particles 3*b* (the first pixel G1: yellow particles, the second pixel G2: magenta particles, and the third pixel G3: cyan particles) are collected in the strong electric field area (area A) by applying an AC voltage to the first electrode 4 and the third electrode 12, whereby the white scattering layers 9*a*, 9*b* and 9*c* are exposed. As a result, incident light is directively scattered to effect bright white display.

In the case of monochromatic display of red, green or blue, e.g., in the case of green display, as shown in FIG. 13(*b*), at the first pixel G1, the yellow second particles 3*b* are collected on the third electrode 12 and at the yellow second pixel G1, the green first particles 3*a* are collected on the third electrode 12. Further, at the third pixel G3, the cyan second particles 3*b* are collected on the third electrode 12. As a result, incident light assumes green by additive color mixture of a yellow light flux (component) scattered at the first pixel G1, a green light flux scattered at the third pixel G2, and a ??**.

In the case of complementary display of cyan, magenta or yellow, e.g., in the case of magenta display as shown in FIG. 13(*c*), the blue first particles 3*a* are collected on the third electrode 12 at the first pixel G1. Further, at the second pixel G2, the magenta second particles 3*b* are collected on the third electrode 12 and at the third pixel G3, the red first particles 3*a* are collected on the third electrode 12. As a result, incident light assumes magenta by addition color mixture of a blue light flux scattered at the first pixel G1, a magenta light flux scattered at the second pixel G2, and a red light flux scattered at the third pixel G3.

In the case of black display, as shown in FIG. 13(*d*), at all the pixels G1 to G3, the first particles 3*a* (the first pixel G1: blue particles, the second pixel G2: green particles, and the third pixel G3: red particles) are collected on the second electrode 4 and the second particles 3*b* (the first pixel G1: yellow particles, the second pixel G2: magenta particles, and the third pixel G3: cyan particles) are collected on the third electrode 12. As a result, incident light is absorbed by the first particles 3*a* and the second particles 3*b* of colors which are complementary color relationship to each other to effect black display.

As described above, also in this embodiment, by selectively applying a DC voltage or an AC voltage to a desired electrode, it becomes possible to effect display of a single color of white, black, red, green or blue or display of a complementary color of cyan, magenta, or yellow, by a combination of the colors of two types of particles 3*a* and 3*b*, the color of the coloring layer 9*a*, 9*b* or 9*c*, and the color of subtractive color mixture of the two types of particles.

Incidentally, the constitutions shown in FIGS. 12 and 13 may preferably be realized by using microcapsules (as shown in FIG. 4). In this case, the first electrode 4 is formed in a gap surrounded by the first and second substrates and the surface of microcapsule.

Example 1

A specific example of the above described embodiments of the present invention will be described.

Figure 14:
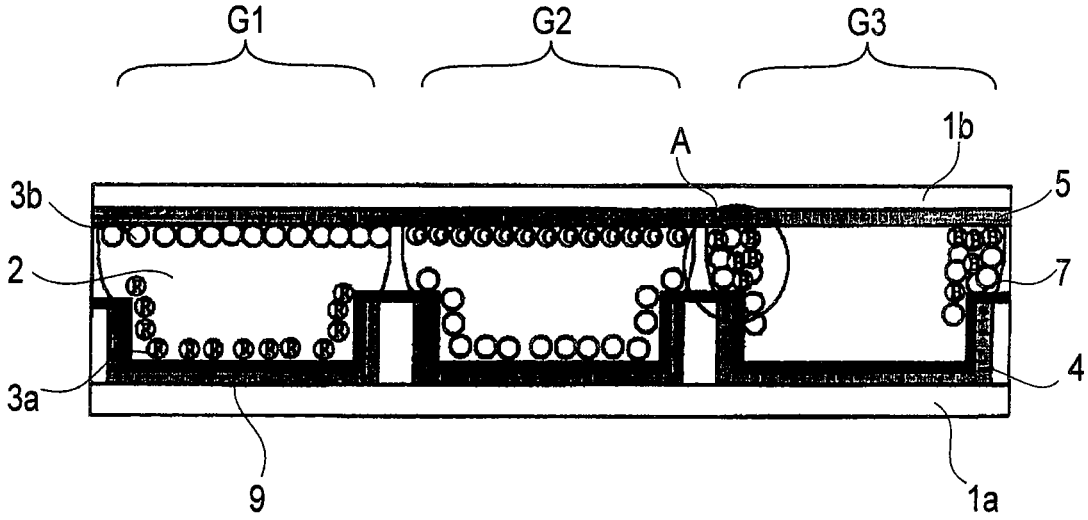
FIG. 14 is a schematic view showing a structure of an electrophoretic display device provided to an electrophoretic display apparatus, capable of effecting color display, according to Example 1 of the present invention.

In this example, an electrophoretic display device as shown in FIG. 14 is prepared. In the electrophoretic display device shown in FIG. 14, one pixel is constituted by three pixels G1 to G3 disposed in parallel with each other. Each of the pixels G1 to G3 has a size of 40 μm (width)×120 μm (length), so that one pixel has a size of 120 μm×120 μm. Further, the resultant electrophoretic display device has 600×600 pixels.

The electrophoretic display device is prepared in the following manner.

On a 1.1 mm-thick glass substrate as a first substrate 1*a*, a thin film transistor (TFT) (not shown), an IC (not shown), and other wirings necessary for drive are formed and thereon, an $Si_3N_4$ film as an insulating film is formed at the entire surface of the substrate. Next, a partition wall 7 having a height of 10 μm and a width of 7 μm is formed. At this time, in order to ensure an electrical contact of the TFT with a first electrode 4, a contact hole (not shown) is provided in advance.

Then, an Al layer is formed and subjected to patterning to form the first electrode 4. At the time of forming the Al layer, the TFT and the first electrode 4 are electrically connected with each other through the contact hole. Thereafter, a black (coloring) layer 9 is applied so as to cover all the resultant substrate surface. Then, on the partition wall 7, another partition wall having a height of 5 μm and a width which becomes narrower to 3 μm as it is closer to its uppermost portion. The partition wall has a total height of 15 μm.

At each of the pixels G1 to G3, migration particles 3*a* and 3*b* and isoparaffin as a dispersion medium 2 (trade name: "ISOPAR", mfd. by Exxon Corp.) are filled. At the first pixel G1, white second particles 3*b* and red first particles 3*a* are disposed. At the second pixel G2, white second particles 3*b* and green first particles 3*a* are disposed. At the third pixel G3, white second particles 3*b* and blue first particles 3*a* are disposed. The migration particles 3*a* and 3*b* are disposed by an ink jet apparatus provided with multi-nozzles.

In the dispersion medium (isoparaffin) 2, a charge control agent is contained, whereby the white second particles 3*b* are negatively charged, and the red, green, and blue first particles 3*a* are positively charged. Further, the migration particles 3*a* and 3*b* and the dispersion medium 2 have relative dielectric constants which satisfy a relationship of (relative dielectric constants of migration particles)>(relative dielectric constant of dispersion medium) and provide a difference in relative dielectric constant therebetween of not less than 8.

On the other hand, as a second substrate 1*b*, a 100 μm-thick PET film is used and thereon, an ITO electrode is formed at the entire surface to provide a second electrode 5. On the surface of the second electrode 4, an insulating layer (not shown) is formed. The thus prepared second substrate 1*b* is disposed on the partition wall to seal the dispersion medium to prepare an electrophoretic display device.

Next, the thus prepared electrophoretic display device is connected with an unshown driver to test a display operation.

More specifically, the second electrode 5 as a common electrode to all the pixels is grounded to 0 V, and a writing signal is applied to the first electrode 4. Further, similarly as in an ordinary active matrix drive, a selection signal is sequentially applied to scanning lines and in synchronism with a selection period, as a writing signal corresponding to the selected scanning line, a writing signal for effecting color display of, e.g., white, a single color, a complementary color, and black.

Figure 15:
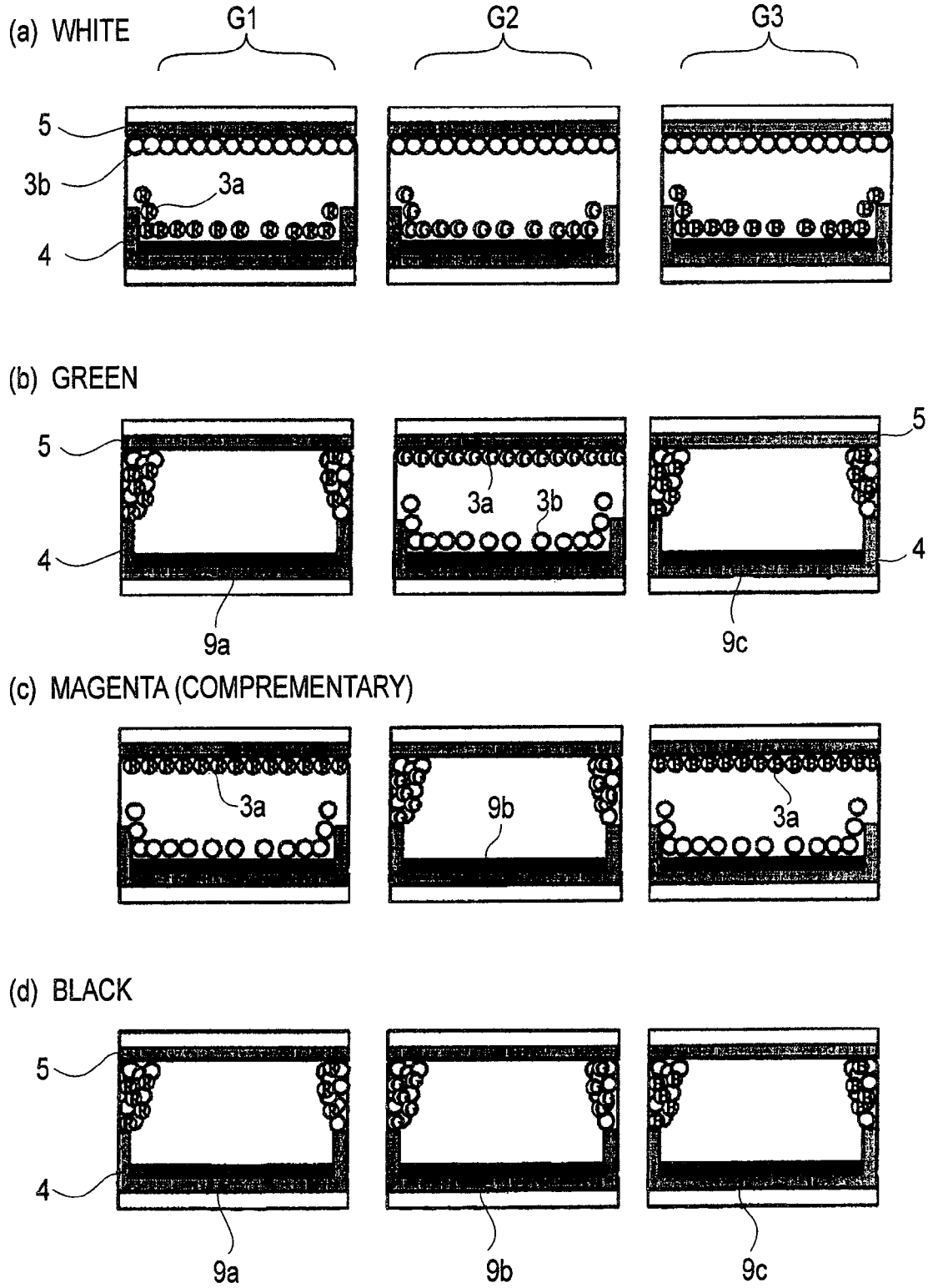
FIGS. 15(*a*) to 15(*d*) are schematic views for illustrating a color display method (driving method) for the electrophoretic display device shown in FIG. 14.

Here, in the case of white display, a DC voltage of −10 V as the writing signal is applied to the first electrode 4 of all the pixels, whereby as shown in FIG. 15(*a*), the white second particles 3*b* are moved onto the second electrode 5 at all the pixels G1 to G3 to effect white display. As a result, it becomes possible to effect bright white display in which incident light is completely scattered.

In the case of green display, a sine wave (an AC voltage of ±15 V, a frequency of 1 kHz) as the writing signal is applied to the first electrode 4 at the first pixel G1. To the first electrode 4 at the second pixel G2, a DC voltage of +10 V is applied as the writing signal. To the first electrode 4 at the third pixel G3, a sine wave (an AC voltage of ±15 V, a frequency of 1 kHz) is applied as the writing signal.

As a result, as shown in FIG. 15(*b*), at the first pixel G1, the black (coloring) layer 9*a* is exposed, thus effecting black display. At the second pixel G2, green display is performed by moving the green first particles 3*a* onto the second electrode 5. At the third pixel G3, the black layer 9*c* is exposed, thus effecting black display. Accordingly, green display is realized by a green light flux (component) scattered at the second pixel G2.

In the case of magenta display, to the first electrode 4 at the first pixel G1, a DC voltage of +10 V is applied as the writing signal. To the first electrode 4 at the second pixel G2, a sine wave (an AC voltage of ±15 V, a frequency of 1 kHz) is applied as the writing signal. To the first electrode at the third pixel G3, a DC voltage of +10 V is applied as the writing signal.

As a result, as shown in FIG. 15(*c*), at the first pixel G1, red display is effected by moving the red first particles 3*a* onto the second electrode 5, and at the second pixel G2, the black (coloring) layer 9*b* is exposed, thus effecting black display. Further, at the third pixel G3, the blue first particles 3*a* are moved onto the second electrode 5 to effect blue display. Accordingly, magenta display is realized by additive color mixture of a red light flux scattered at the first pixel G1 and a blue light flux scattered at the third pixel G3.

In the case of black display, a sine wave (an AC voltage of ±15 V, a frequency of 1 kHz) is applied as the writing signal to the first electrode 4 at all the pixels G1 to G3. As a result, as shown in FIG. 15(*d*), at all the pixels G1 to G3, the black layers 9*a*, 9*b* and 9*c* are exposed, whereby black display is realized.

The colors of color displays effected in the above described methods are bright and clear to provide effects in line with expectations.

While the invention has been described with reference to the structures disclosed herein, it is not confined to the details set forth and this application is intended to cover such modifications or changes as may come within the purposes of the improvements or the scope of the following claims.

This application claims priority from Japanese Patent Applications Nos. 019057/2004 filed Jan. 27, 2004 and 005197/2005 filed Jan. 12, 2005, which are hereby incorporated by reference.

What is claimed is:

1. A display apparatus, comprising:

a first substrate provided with a plurality of closed containers, a fluid filled in the closed containers, a plurality of positively charged particles which have a relative dielectric constant different from the fluid and are dispersed and held in the fluid, a plurality of negatively charged particles which have a relative dielectric constant different from the fluid and are dispersed and held in the fluid, and a pair of electrodes, having a first electrode and a second electrode, for generating an electric field in the closed containers, wherein the pair of electrodes generate an electric field having a non-uniform electric field strength in each of the closed containers, wherein a first DC voltage is applied between the pair of electrodes to distribute the positively charged particles at the first electrode and to distribute the negatively charged particles at the second electrode, wherein a second DC voltage having a polarity opposite to that of the first DC voltage is applied between the pair of electrodes to distribute the negatively charged particles at the first electrode and to distribute the positively charged particles at the second electrode, and wherein an AC voltage is applied between the pair of electrodes to distribute the positively charged particles and negatively charged particles at a maximum electric field strength position or at a minimum electric field strength position, depending on a difference in relative dielectric constant between the positively charged particles and the fluid and between the negatively charged particles and the fluid, wherein the first electrode is provided proximate to the first substrate, and the second electrode is provided proximate to a second substrate disposed opposite to the first substrate, and at least one of the first and second electrodes has a projected portion at a center of the closed container.

2. A display apparatus according to claim 1, wherein the first DC voltage and the second DC voltage are applied alternately to effect visually identified display states.

3. A display apparatus according to claim 1, wherein the first substrate is colored differently from the color of the positively and negatively charged particles.

4. A display apparatus according to claim 1, wherein the fluid is transparent, and in the case where the display apparatus is viewed from an image display surface side, the positively or negatively charged particles are observed when the positively or negatively charged particles are distributed at one of the pair of electrodes, and a substrate surface is observed when the positively charged particles or the negatively charged particles are distributed at a maximum electric field strength position or a minimum electric field strength position.

5. A display apparatus according to claim 1, wherein the closed containers are microcapsules which are disposed between the first substrate and the second substrate.

6. A display apparatus according to claim 1, wherein the first electrode provided to the first substrate is extended to a space surrounded by the first substrate and an outer surface of a microcapsule or the second electrode provided to the second substrate is extended to a space surrounded by the second substrate and an outer surface of a microcapsule.

7. A display apparatus according to claim 1, wherein the charged particles have a relative dielectric constant larger than that of the fluid and are distributed at a maximum electric field position by application of the AC voltage.

8. A display apparatus according to claim 1, wherein the charged particles have a relative dielectric constant smaller than that of the fluid and are distributed at a minimum electric field position by application of the AC voltage.

* * * * *